US006520701B2

(12) United States Patent
Kaya

(10) Patent No.: US 6,520,701 B2
(45) Date of Patent: Feb. 18, 2003

(54) CUTTER DEVICE FOR CUTTING SHEET AND PRINTER HAVING THE SAME

(75) Inventor: Akimasa Kaya, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/730,858

(22) Filed: Dec. 7, 2000

(65) Prior Publication Data

US 2001/0000463 A1 Apr. 26, 2001

(30) Foreign Application Priority Data

Dec. 8, 1999 (JP) ..... 11-349072

(51) Int. Cl.[7] ..... B26D 7/00

(52) U.S. Cl. ..... 400/621; 400/593; 101/226; 83/446; 83/452; 83/455; 83/648

(58) Field of Search ..... 400/621, 593; 101/224, 226, 227; 83/455, 614, 446, 454, 648, 452, 448, 449

(56) References Cited

U.S. PATENT DOCUMENTS 5,379,668 A * 1/1995 Standing ..... 83/167
5,791,218 A * 8/1998 Saito et al. ..... 83/385
6,131,496 A * 10/2000 Schaede ..... 83/151
6,260,457 B1 * 7/2001 Hakkaku ..... 83/167
6,302,602 B1 * 10/2001 Kiyohara et al. ..... 400/593

FOREIGN PATENT DOCUMENTS

JP 7-107228 4/1995

* cited by examiner

*Primary Examiner*—Andrew H. Hirshfeld
*Assistant Examiner*—Kevin D. Williams
(74) *Attorney, Agent, or Firm*—Sughrue Mion, PLLC

(57) ABSTRACT

A cutter device includes at least one stationary blade, which has a stationary blade cutting edge extending crosswise to a recording sheet. At least one movable blade moves in contact with the stationary blade cutting edge to cut the recording sheet. A stopper plate prevents the recording sheet from being moved by the movable blade while the movable blade cuts the recording sheet. In a preferred embodiment, the stopper plate is shiftable between a stopper position and a retracted position, and when in the stopper position, contacts a side edge of the recording sheet, and when in the retracted position, is away from the side edge.

20 Claims, 16 Drawing Sheets

CUTTER DEVICE FOR CUTTING SHEET AND PRINTER HAVING THE SAME

BACKGROUND OF THE INVENTION

1. Field of the Invention

The present invention relates to a cutter device and a printer having the same, and more particularly, relates to a cutter device and a printer having the same, capable of neatly treating dust created by cutting sheet material.

2. Description Related to the Prior Art

A color thermal printer is a device according to three-color frame-sequential recording. A recording sheet is fed in a feeding direction as either one of forward and backward directions. During the feeding, one thermal head records three-color images to the recording sheet.

In the thermal printer, a capstan roller and a pinch roller nip the recording sheet and feed the recording sheet in forward and backward directions while the capstan roller is driven. A thermal head thermally prints an image one color after another while the recording sheet is fed in either of the directions. To stabilize the thermal printing, a recording region is defined in the recording sheet with a smaller size for recording of the image. There occur margins about the recording region. On the other hand, marginless prints are widely used in the field of the silver halide photograph. It is conceivable in the thermal recording for prints not to have the margins. Therefore, it is necessary to cut the margins away from the recording region.

To cut the margins, it is possible to use a front and rear margin cutter unit or a slitter for cutting away lateral margins.

JP-A 7-107228 discloses an example of the front and rear margin cutter unit, which includes a movable blade and a stationary blade between which a path for the recording sheet is disposed. The movable blade is moved in a cutting direction which is perpendicular to the feeding direction of the recording sheet. The stationary blade has a plate shape and has a straight cutting edge extending in the cutting direction. The movable blade moves in contact with the stationary blade to cut the recording sheet in the cutting direction.

In the front and rear margin cutter unit of the document above, the movable blade moves in the cutting direction. If the recording sheet should move in the cutting direction even to a small extent, straight cutting is impossible. A side edge to be cut finally is likely to be squeezed between the movable blade and the stationary blade and to move with the movable blade. When the movable blade returns to the initial position, dust from the margin drops, and may be scattered on a lower surface of the thermal printer. Scattered dust, if cutting is repeated, is likely to influence various mechanisms in the thermal printer.

SUMMARY OF THE INVENTION

In view of the foregoing problems, an object of the present invention is to provide a cutter device and a printer having the same, capable of reliable cutting operation without failure, and neatly treating dust created by the cutting operation.

In order to achieve the above and other objects and advantages of this invention, a cutter device includes at least one stationary blade having a stationary blade cutting edge extending crosswise to sheet material. At least one movable blade moves in contact with the stationary blade cutting edge to cut the sheet material. A retention mechanism prevents the sheet material from being moved by the movable blade while the movable blade cuts the sheet material.

Furthermore, a moving mechanism moves the movable blade forwards along the stationary blade cutting edge from an initial position to a shifted position, and then moves the movable blade backwards from the shifted position to the initial position to cause the movable blade to stand by.

The retention mechanism includes a stopper plate, disposed close to the shifted position of the movable blade, for contacting a side edge of the sheet material to prevent the sheet material from moving.

Furthermore, a guide member has at least one portion opposed to the sheet material, and is provided with the stopper plate projecting therefrom, for guiding the sheet material being fed in a position downstream or upstream from the stationary and movable blades.

Furthermore, a shifter mechanism causes the guide member to shift the stopper plate between first and second positions. The stopper plate, when in the first position, contacts the side edge, and when in the second position, is away from the side edge.

The movable blade is disposed away from the sheet material when in the initial position, and reaches the sheet material to start cutting when moved from the initial position to a cutting starting position. The shifter mechanism moves the stopper plate to the first position before the movable blade is moved from the initial position to the cutting starting position, and keeps the stopper plate in the first position while the movable blade is between the cutting starting position and the shifted position.

Furthermore, a blade holder supports the movable blade and is moved by the moving mechanism.

The shifter mechanism includes a first engaging portion formed with the guide member. A second engaging portion is formed with the blade holder, for setting the stopper plate in the first position by pushing the first engaging portion.

The moving mechanism includes a cutter motor for rotating in one direction. An endless belt or chain has first and second portions extending substantially in parallel with each other, and is turned by the cutter motor. A clutch is connected between the belt or chain and the blade holder, for causing the blade holder to move forwards by transmitting movement of the first portion thereto, and to move backwards by transmitting movement of the second portion thereto.

The moving mechanism includes a cutter motor for moving forwards the blade holder by rotating forwards, and for moving backwards the blade holder by rotating backwards.

The movable blade is a rotatable circular blade.

The sheet material is a recording sheet, and includes a recording region adapted to image recording. At least first and second margin regions are positioned downstream and upstream from the recording region in a feeding direction crosswise to the stationary blade cutting edge. The at least one movable blade cuts the first or second margin region away from the recording region.

The at least one movable blade is first and second movable blades, and the at least one stationary blade is first and second stationary blades. Front and rear margin cutters are arranged in the feeding direction, for cutting respectively the first and second margin regions from the recording region, the front margin cutter including the first movable blade and the first stationary blade, the rear margin cutter including the second movable blade and the second stationary blade. The retention mechanism is arranged between the front and rear margin cutters, and operates while the front margin cutter is actuated or while the rear margin cutter is actuated.

Furthermore, a feeder feeds the sheet material in the feeding direction. A controller controls the feeder to position the first and second margin regions at respectively the first and second stationary blades in actuation of the front and rear margin cutters.

Furthermore, a dust receiver chamber is disposed substantially under the at least one stationary blade, for receiving the first or second margin region cut away from the recording region.

In a preferred embodiment, a printer is provided for image recording to a recording sheet, the recording sheet including a recording region adapted to image recording, and at least first and second margin regions positioned downstream and upstream from the recording region in a feeding direction. In the printer, at least one stationary blade has a stationary blade cutting edge extending crosswise to the feeding direction. At least one movable blade moves in contact with the stationary blade cutting edge to cut the first or second margin region away from the recording region. A retention mechanism prevents the recording sheet from being moved by the movable blade while the movable blade cuts away the first or second margin region.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
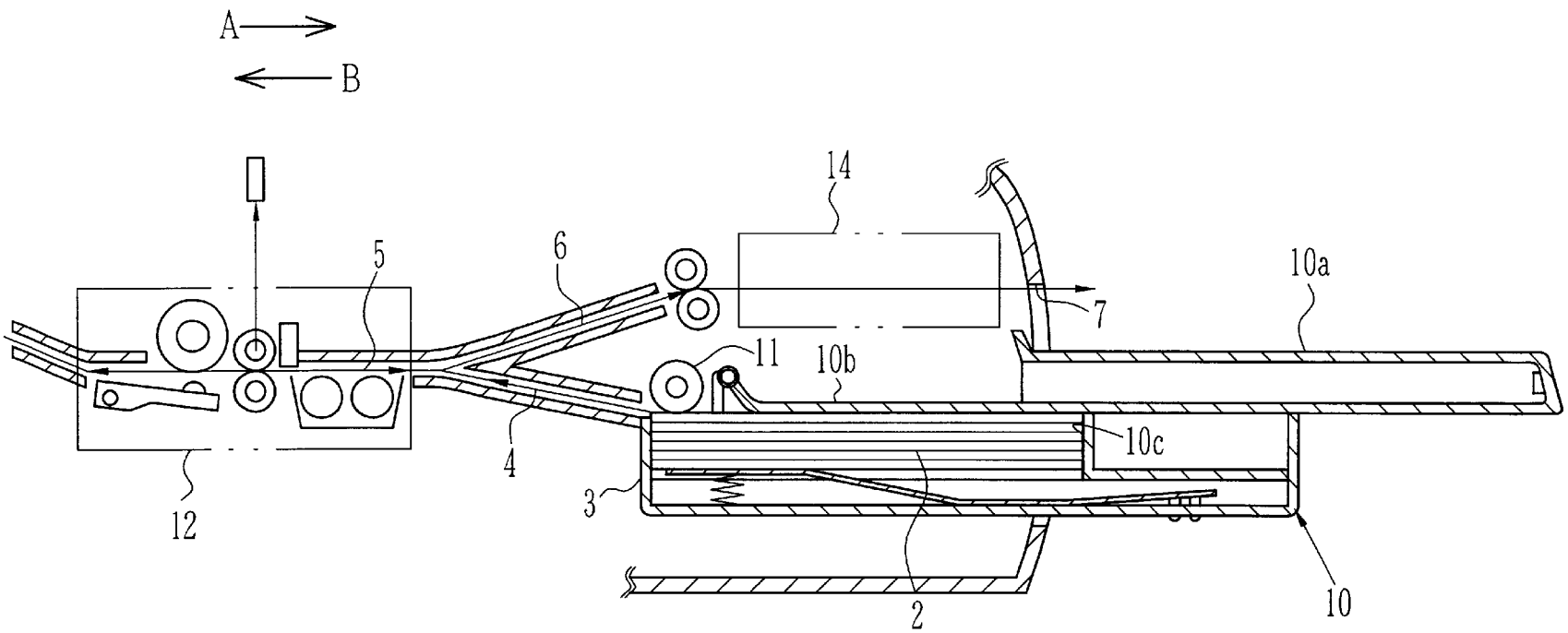
FIG. 1 is a vertical section illustrating a color thermal printer of the invention.

In FIG. 1, a printer having a cutter device is illustrated. A thermosensitive recording sheet 2 as sheet material is used in the printer, which is changeable over between a margin mode and a marginless mode. In the marginless mode, margins are cut away from the recording sheet 2. In the margin mode, there is no cutting of margins.

A sheet supply unit 3 supplies the recording sheet 2 in the direction opposite to the arrow in the drawing. A supply path 4 causes the recording sheet 2 to pass to a recording path 5. An image recorder 12 records an image to the recording sheet 2, before the recording sheet 2 is fed forwards to a cutting path 6. A cutter device 14 at the cutting path 6 cuts or slits margins in the recording sheet 2. An ejection slot 7 ejects the recording sheet 2 from the printer. The supply path 4 and the cutting path 6 are disposed on the right side in the printer as viewed in the drawing, and are branches of the recording path 5 in such a manner that the ejection slot 7 is located over the sheet supply unit 3. A sheet cassette 10 is mounted in the sheet supply unit 3. A supply roller 11 in the sheet supply unit 3 supplies an uppermost one of plural recording sheets 2 in the sheet cassette 10. The cutter device 14 cuts away margins defined about a recording region.

The sheet cassette 10 includes a tray 10*a* and a dust receiver chamber 10*b*. The tray 10*a* receives the recording sheet 2 ejected through the ejection slot 7. The dust receiver chamber 10*b* is under the tray 10*a*, and receives dust created by the cutter device 14. A container chamber 10*c* is formed inside the printer. The dust receiver chamber 10*b* is contained in the printer when set in the container chamber 10*c*.

Figure 2:
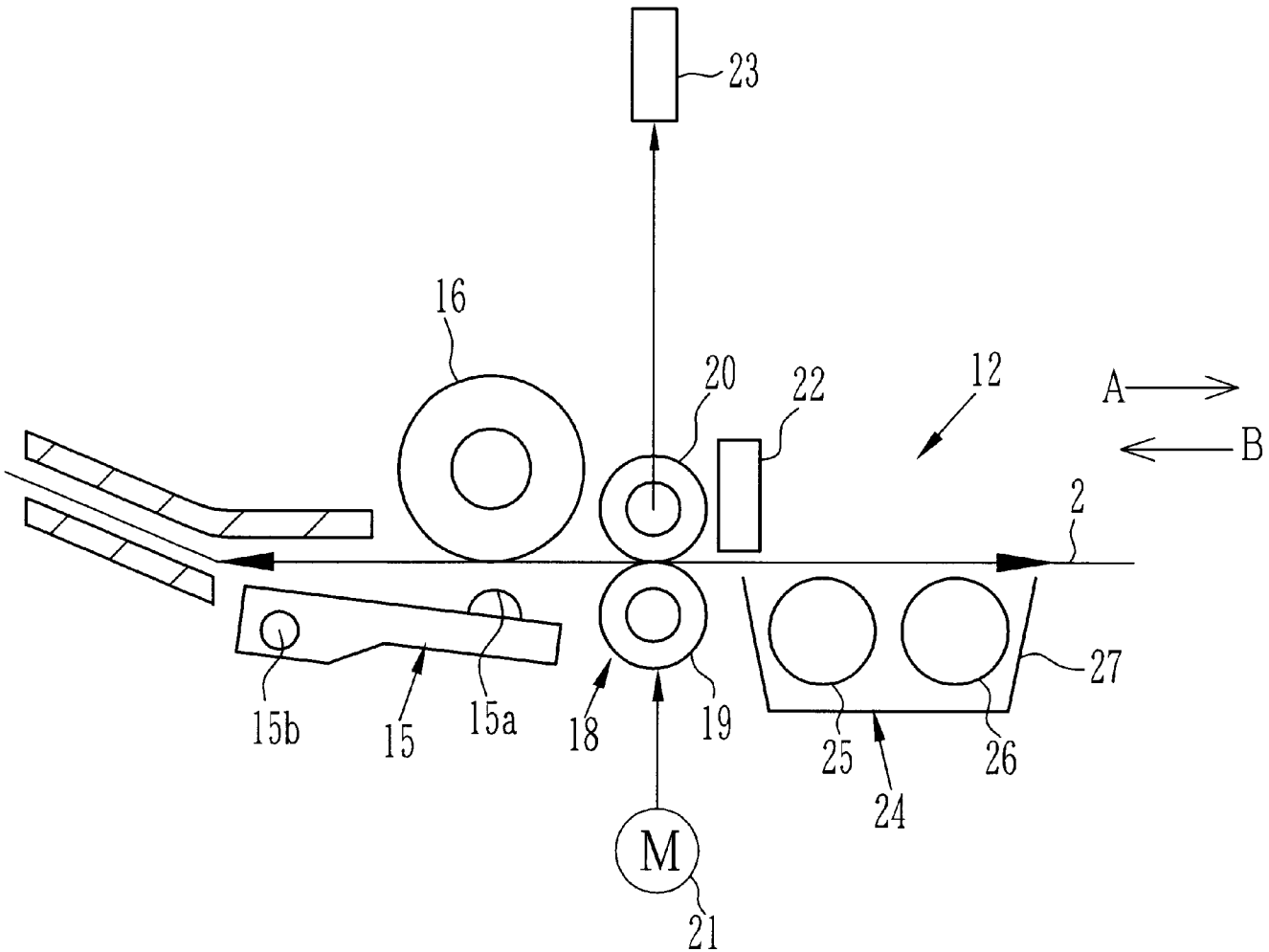
FIG. 2 is an explanatory view illustrating an image recorder in the thermal printer.

The image recorder 12 is structured for color thermal recording of a full-color image according to three-color frame-sequential recording. In FIG. 2, a thermal head 15 and a platen roller 16 are positioned upstream from the recording path 5. A heating element array 15a constitutes the thermal head 15, and includes numerous linearly arranged heating elements. The thermal head 15 is pivotally movable about a pivot 15*b* between first and second positions, and when in the first position, pushes the recording sheet 2 on the platen roller 16, and when in the second position, is away from the platen roller 16.

The recording sheet 2, as well-known in the art, includes a support, and cyan, magenta and yellow thermosensitive coloring layers overlaid thereon in sequence. The yellow coloring layer is positioned the farthest from the support, has the highest heat sensitivity, and develops the yellow color in response to low heat energy. The cyan coloring layer is positioned the deepest on the support, has the lowest heat sensitivity, and develops the cyan color in response to high heat energy. The yellow coloring layer has such fixability that its coloring ability is destroyed upon application of near ultraviolet rays with a wavelength of approximately 420 nm. The magenta coloring layer has the medium heat sensitivity between the highest and lowest, and develops the magenta color in response to medium heat energy, and has such fixability that its coloring ability is destroyed upon application of ultraviolet rays with a wavelength of approximately 365 nm. Note that it is possible for the recording sheet 2 to have four or more coloring layers, for example including a black coloring layer.

Feeder rollers 18 are positioned downstream from the thermal head 15, and feed the recording sheet 2. The feeder rollers 18 include a capstan roller 19 and a pinch roller 20, which is rotatable above the capstan roller 19. The capstan roller 19 is lower than the recording sheet 2. A feeder motor 21 drives the capstan roller 19, and consists of a stepping motor. The pinch roller 20 is movable between positions on and away from the capstan roller 19. When a position sensor 22 detects a front edge of the recording sheet 2, the feeder rollers 18 squeeze the recording sheet 2 by pressure of the pinch roller 20. The capstan roller 19 is driven to rotate to feed the recording sheet 2 in directions A and B, of which the direction A is from the supply to the ejection, and the direction B is from the ejection to the supply.

An encoder 23 is connected with a rotational shaft of the pinch roller 20, and measures an amount of feeding the recording sheet 2 by detecting the number of rotations made by the pinch roller 20.

An optical fixer 24 is positioned downstream from the feeder rollers 18, and includes a yellow fixing lamp 25, a magenta fixing lamp 26 and a reflector 27. The yellow fixing lamp 25 emits near ultraviolet rays of which a peak is at a wavelength of 420 nm. The magenta fixing lamp 26 emits ultraviolet rays of which a peak is at a wavelength of 365 nm. The reflector 27 covers the rear of the yellow and magenta fixing lamps 25 and 26.

Figure 3:
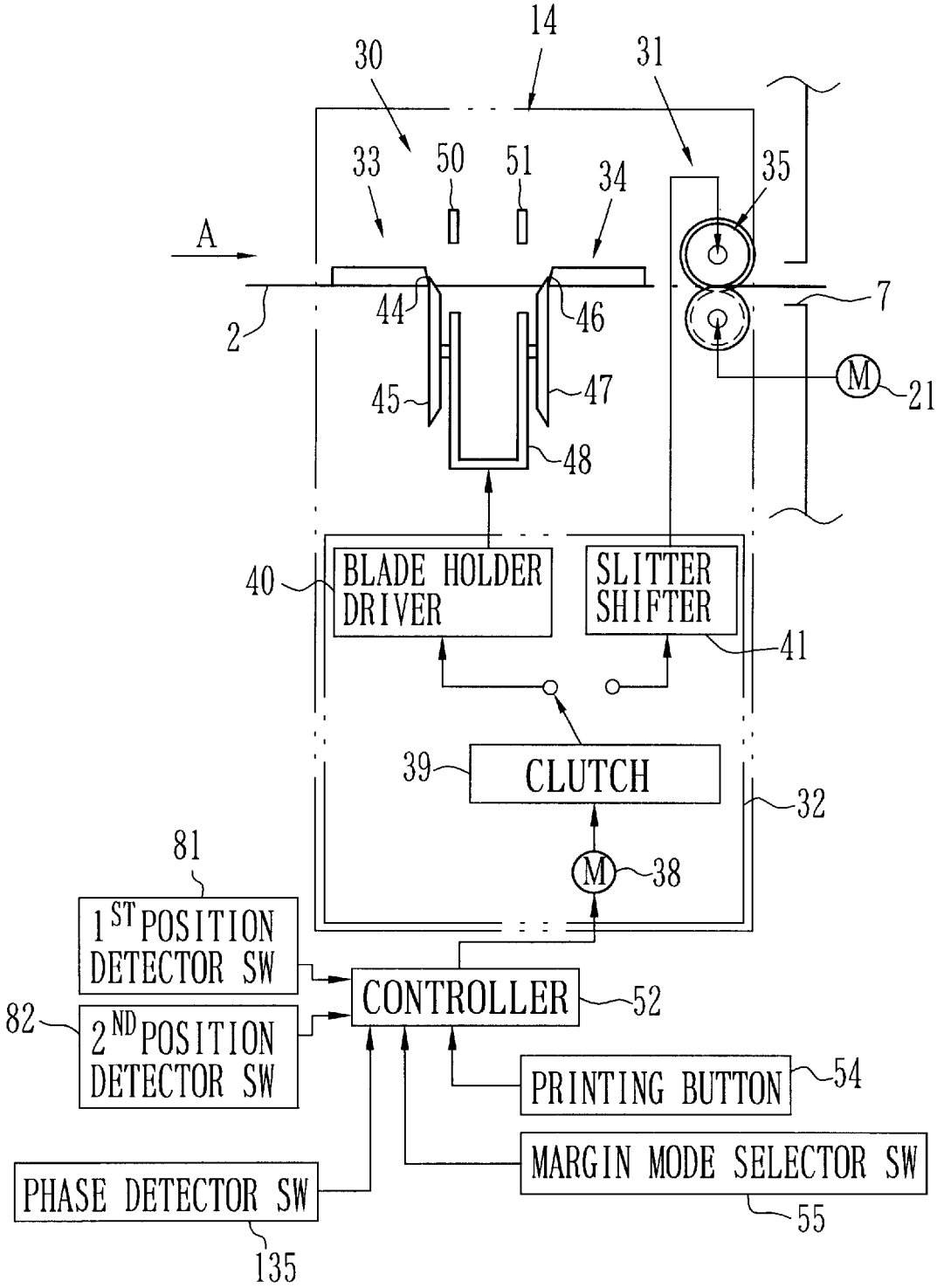
FIG. 3 is a block diagram illustrating a cutter device.
Figure 4:
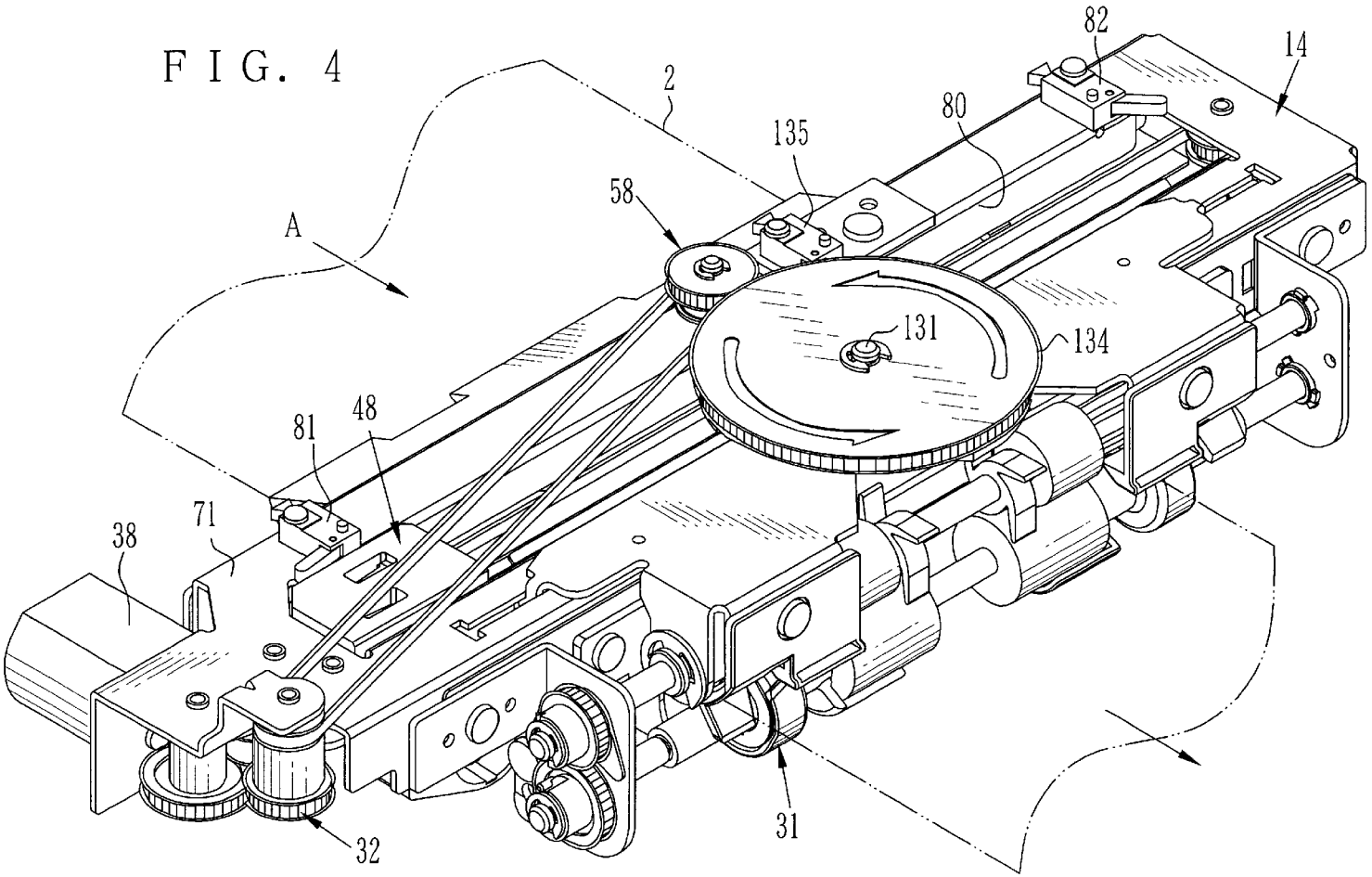
FIG. 4 is a perspective illustrating the cutter device.

In FIG. 3, the cutter device 14 includes front and rear margin cutter group 30, a stopper, a slitter unit 31, and a moving unit 32. The front and rear margin cutter group 30 is positioned upstream in the cutter device 14. The slitter unit 31 is positioned downstream from the front and rear margin cutter group 30. The moving unit 32 is a drive mechanism for driving the front and rear margin cutter group 30 and the slitter unit 31 by means of a single prime mover. Appearance of the cutter device 14 is depicted in FIG. 4.

In FIG. 3, the front and rear margin cutter group 30 includes a front margin cutter 33 and a rear margin cutter 34. The front margin cutter 33 cuts the recording sheet 2 along a cutting line extending in its width direction, and cuts away a front margin from a recording region, the front margin being positioned downstream. The rear margin cutter 34 cuts the recording sheet 2 along a cutting line extending in its width direction, and cuts away a rear margin from the recording region, the rear margin being positioned upstream.

The slitter unit 31 is so positioned that the recording sheet 2 from the rear margin cutter 34 is fed to the slitter unit 31. A slitter/ejector roller set 35 is included in the slitter unit 31, is driven by the feeder motor 21, and nips the recording sheet 2 and feeds the same in the forward direction A. The slitter unit 31 slits the recording sheet 2 along cutting lines in the feeding direction, and cuts right and left margins away from the recording sheet 2 about an image recording region.

The moving unit 32 includes a single cutter motor 38, a clutch 39, a blade holder driver 40 and a slitter shifter 41.

The clutch 39 for changing over the transmission transmits rotation to the cutter motor 38 to a selected one of the blade holder driver 40 and the slitter shifter 41 according to a rotational direction of the cutter motor 38. The blade holder driver 40 converts the rotation of the cutter motor 38 in one direction to straight movement in back and forth directions. The front and rear margin cutter group 30 cuts front and rear margins of the recording sheet 2 by use of the straight movement. The slitter shifter 41 transmits rotation of the cutter motor 38 in the second direction to the slitter unit 31.

The front margin cutter 33 includes a first stationary blade 44 and a first circular blade 45 as movable blade. The rear margin cutter 34 is positioned downstream from the front margin cutter 33, and includes a second stationary blade 46 and a second circular blade 47 as movable blade. A blade holder 48 supports the first and second circular blades 45 and 47, and moves those together when slid by the blade holder driver 40 back and forth in the width direction of the recording sheet 2. In the present embodiment, the first and second circular blades 45 and 47 are disposed under the cutting path 6. The first and second stationary blades 44 and 46 are disposed above the cutting path 6.

A pair of position sensors 50 and 51 are disposed in the cutting path 6. The position sensor 50 detects a rear end of the recording sheet 2. Upon detection of the recording sheet 2 at the position sensor 50, a position designated for cutting at the rear margin is controlled to set in a position of the second circular blade 47. At the same time, the recording sheet 2 does not exist in a position of the first circular blade 45 for front margin cutting.

The position sensor 51 detects a front edge of the recording sheet 2. In response to the detection, a cutting position for a front margin of the recording sheet 2 is set at the first circular blade 45. Now, the recording sheet 2 does not exist in a position of the second circular blade 47 which will operate for cutting a rear margin.

A controller 52 controls the feeder motor 21 in response to a signal from the position sensor 51. At first, the controller 52 drives the feeder motor 21 to feed the recording sheet 2 in the forward direction A, and also monitors the position sensor 51. When the position sensor 51 detects the front edge of the recording sheet 2, the controller 52 discontinues driving the feeder motor 21. For cutting the rear margin, the position sensor 50 is monitored. When the position sensor 50 detects the rear edge of the recording sheet 2, the controller 52 discontinues driving the feeder motor 21.

Note that a printing button 54 and a margin mode selector switch 55 are connected with the controller 52, and operable externally in outer surfaces of the printer. The margin mode selector switch 55 is operable for designating one of the margin mode and marginless mode, to determine either cutting margins away from the recording sheet 2 or no cutting of margins.

Figure 5:
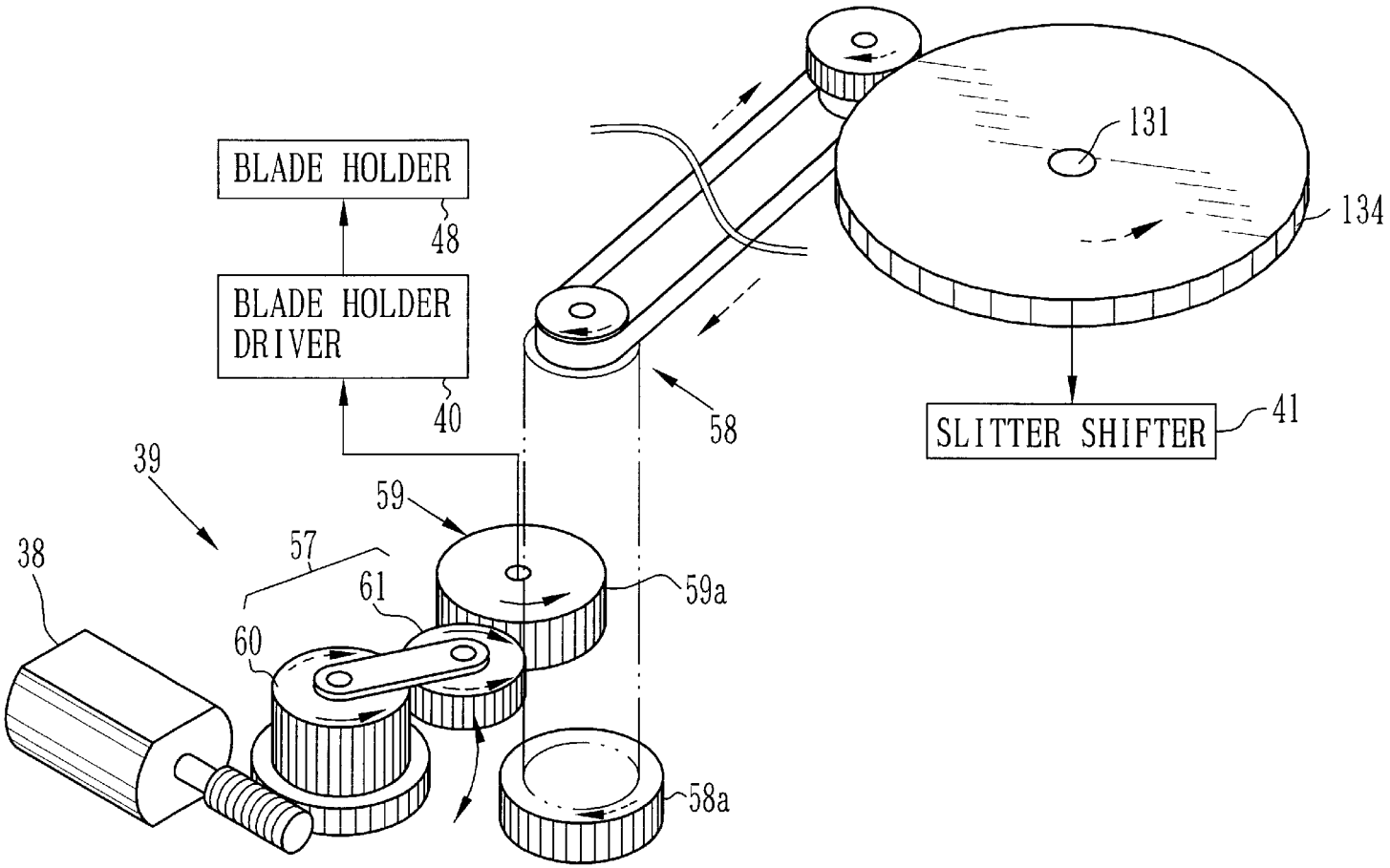
FIG. 5 is a perspective illustrating a moving unit in the cutter device.

In FIG. 5, the clutch 39 is constituted by a planetary gear mechanism 57, a first transmission mechanism 58 and a second transmission mechanism 59. Each of the first and second transmission mechanisms 58 and 59 includes trains of gears, belts and the like. In the planetary gear mechanism 57, a sun gear 60 is rotated by rotation of the cutter motor 38. A planet gear 61 rotates about the sun gear 60, and comes in mesh with a selected one of an input gear 58*a* in the first transmission mechanism 58 and an input gear 59*a* of the second transmission mechanism 59. Thus, the first and second transmission mechanisms 58 and 59 are selectively driven according to the rotational direction of the cutter motor 38. A term of the forward rotational direction is herein used to designate a rotating direction of the cutter motor 38 to transmit rotation to the second transmission mechanism 59. A term of the backward rotational direction is herein used to designate a rotating direction of the cutter motor 38 to transmit rotation to the first transmission mechanism 58.

Figure 6:
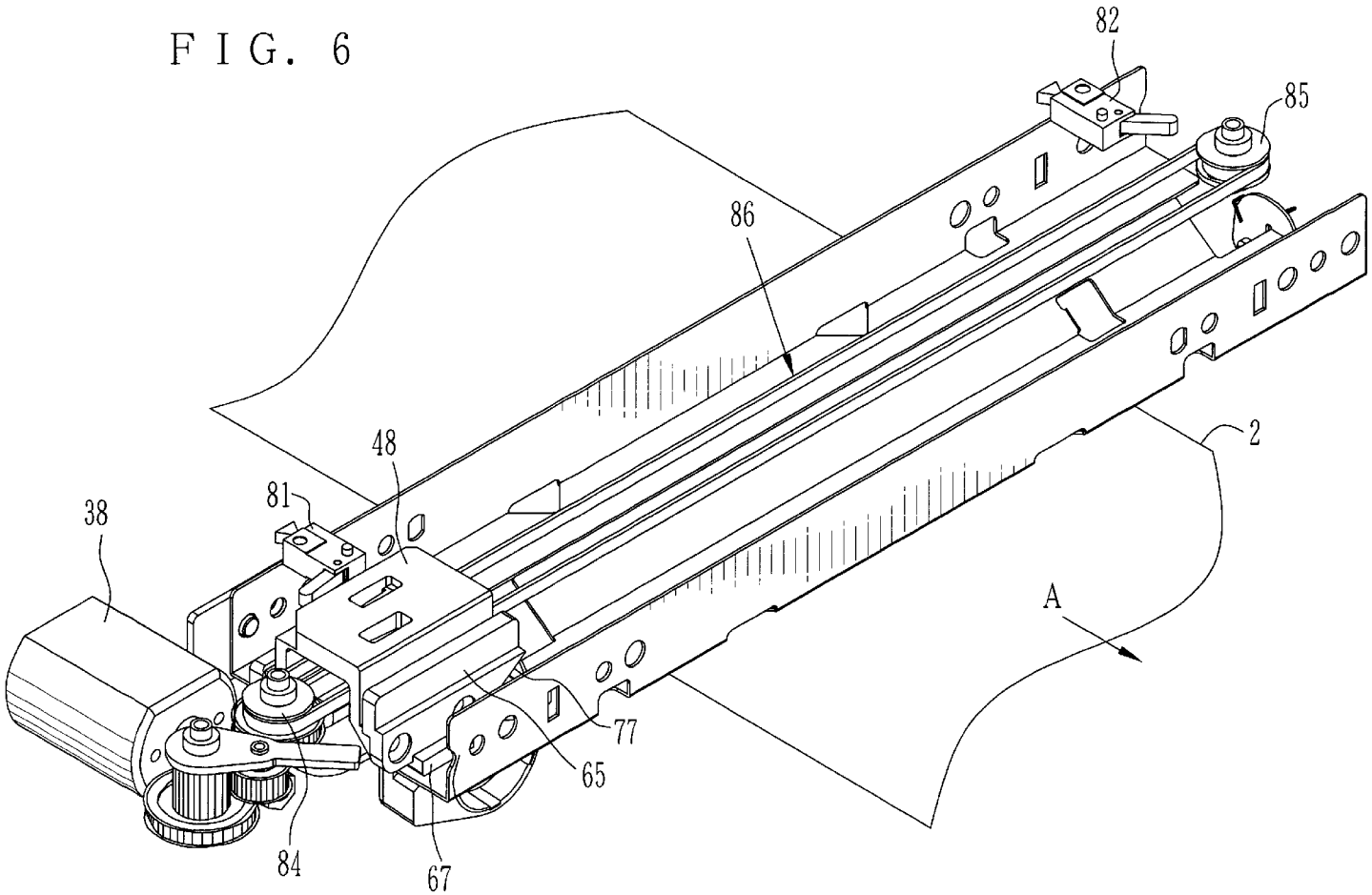
FIG. 6 is a perspective illustrating front and rear margin cutters in the cutter device.
Figure 7:
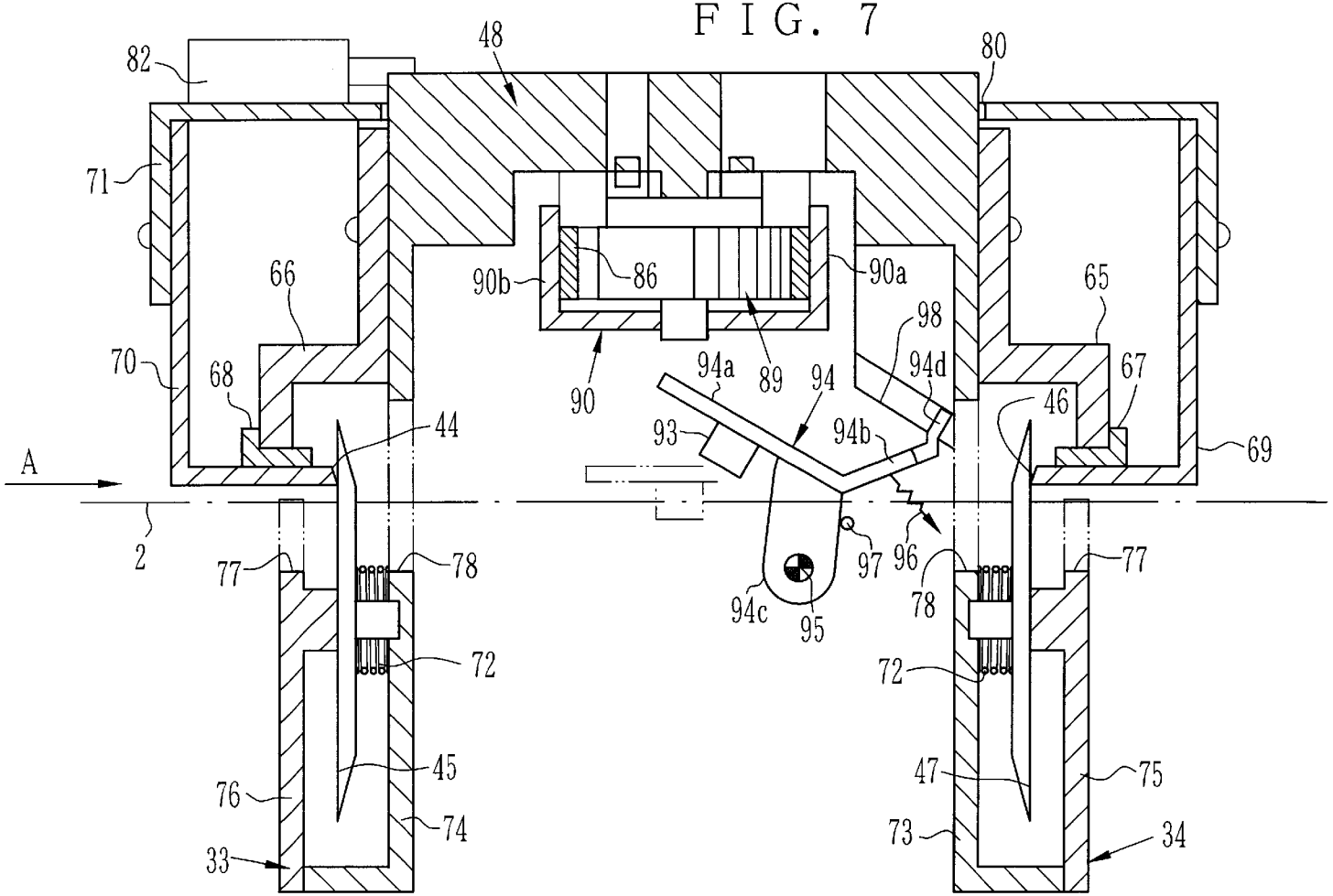
FIG. 7 is a cross section illustrating the front and rear margin cutters with a blade holder.

In FIGS. 6 and 7, the blade holder 48 is so oriented that the open space in its channel shape is directed downwards. The blade holder 48 is guided by guiding means movably in the width direction of the recording sheet 2. The guiding means includes leg portions 65 and 66 and holder guide rails 67 and 68. The leg portions 65 and 66 are fixed on sides of the blade holder 48 and have an L shape as viewed in cross section. The holder guide rails 67 and 68 are engaged with the leg portions 65 and 66. An L-plate 69 supports the holder guide rail 67 secured thereto. Also, an L-plate 70 is positioned upstream from the L-plate 69, and supports the holder guide rail 68 secured thereto. A top plate 71 is an element to which the L-plates 69 and 70 are secured. Shorter segments included in the L-plates 69 and 70 have edges which constitute respectively the first and second stationary blades 44 and 46. The cutting edges of the first and second stationary blades 44 and 46 are opposed to each other.

A pair of support plates 73 and 74 are included in the blade holder 48 to project toward a position under the cutting path 6. The second circular blade 47 is supported on the support plate 73 in a rotatable manner. The first circular blade 45 is supported on the support plate 74 in a rotatable manner. Protectors 75 and 76 are secured to the support plates 73 and 74 and cover the first and second circular blades 45 and 47.

The first and second circular blades 45 and 47 are caused by springs 72 to contact the cutting edges of the first and second stationary blades 44 and 46. There are cutouts 77 formed in the support plates 73 and 74. Cutouts 78 are formed in the protectors 75 and 76. As is not illustrated in the drawings, the cutouts 77 and 78 have shapes open in the direction of the forward movement of the blade holder 48. The first and second circular blades 45 and 47 cut the recording sheet 2 with the first and second stationary blades 44 and 46 in spaces inside the cutouts 77 and 78.

An opening 80 is formed in the top plate 71 for uncovering a top face of the blade holder 48. The opening 80 has a length enough for allowing the blade holder 48 to move, and also keeps the blade holder 48 positioned inside the top plate 71. First and second position detector switches 81 and 82 are secured to the top plate 71 and arranged at an interval in the width direction of the recording sheet 2. The first and second position detector switches 81 and 82 have shiftable segments projecting in a moving path of the blade holder 48. The first position detector switch 81 detects movement of the blade holder 48 to the initial position where the blade holder 48 allows the recording sheet 2 to pass, and sends the controller 52 a signal representing a positioned state of the blade holder 48. The second position detector switch 82 detects a state of overrunning of the blade holder 48 from the shifted position, and sends the controller 52 a signal for urgently discontinuing rotation of the cutter motor 38. The controller 52 controls rotation of the cutter motor 38 in response to signals from the first and second position detector switches 81 and 82.

Figure 8:
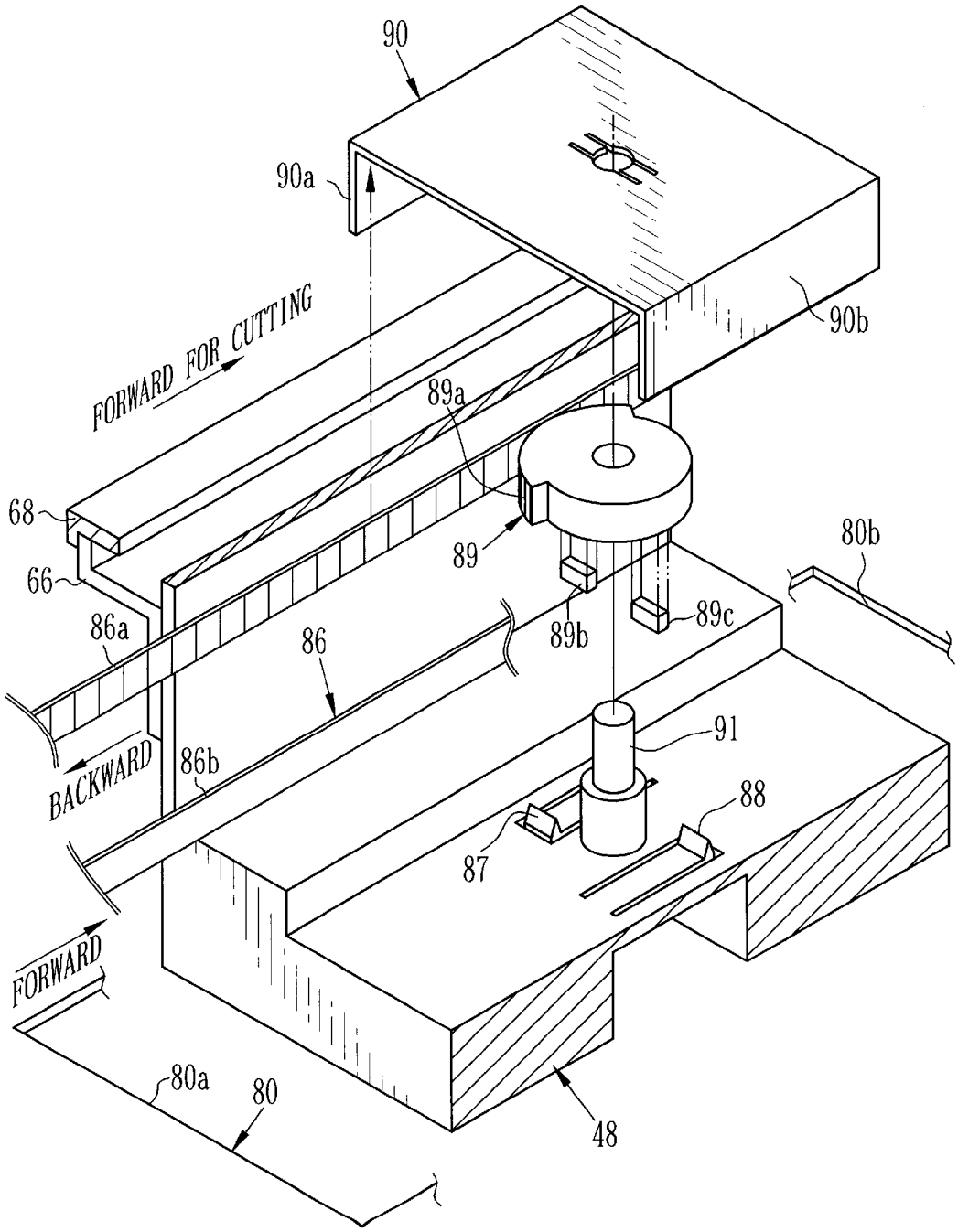
FIG. 8 is an exploded perspective illustrating the blade holder with a blade holder driver.

The blade holder driver 40 includes belt pulleys 84 and 85, a toothed belt 86, resilient clutch claws 87 and 88, a driven wheel 89, a belt guide frame 90 and stoppers 80*a* and 80*b*. See FIG. 8. The driven wheel 89 and the clutch claws 87 and 88 constitute a clutch. The belt pulleys 84 and 85 are arranged in the width direction of the recording sheet 2. The toothed belt 86 is engaged with peripheral edges of the belt pulleys 84 and 85, and extends substantially straight. The toothed belt 86 passes through a U-shaped space in the blade holder 48. The belt pulley 84 is driven by the input gear 59*a* of the second transmission mechanism 59 described with FIG. 5. Thus, the belt pulleys 84 and 85 turn the toothed belt 86 in a single predetermined direction.

A shaft 91 projects from the blade holder 48, and supports the driven wheel 89 in a rotatable manner. A toothed sector portion 89*a* in the clutch is ready to be meshed with one of first and second belt portions 86*a* and 86*b* of the toothed belt 86 for forward and backward movement. The belt guide frame 90 has a channel shape as viewed in cross section, and is positioned fixedly on the shaft 91 to surround the driven wheel 89. The belt guide frame 90 keeps the driven wheel 89 from dropping away in an axial direction. A pair of edge walls 90*a* and 90*b* of the belt guide frame 90 keep each of the first and second belt portions 86*a* and 86*b* engaged with the toothed sector portion 89*a* without slip or disorder.

It is noted that the toothed belt 86 may be any type of endless loop-shaped device, for example a timing belt, a chain, a belt with projections arranged at a long interval, and the like. If a chain is used, the toothed sector portion 89*a* in the driven wheel 89 may be a sector portion with sprocket teeth.

A pair of blocking claws 89*b* and 89*c* project from one of flat surfaces of the driven wheel 89, and are rotationally symmetrical to each other with reference to the shaft 91. When the driven wheel 89 comes in mesh with one of the first and second belt portions 86*a* and 86*b*, the blocking claws 89*b* and 89*c* become engaged with the clutch claws 87 and 88. The clutch claws 87 and 88 are on a surface to be opposed to the blocking claws 89*b* and 89*c*. Cooperation of the clutch claws 87 and 88 with the blocking claws 89*b* and 89*c* of the driven wheel 89 transmits movement of the first or second belt portion 86*a* or 86*b* to the blade holder 48. Thus, the blade holder 48 moves back and forth between an initial position short of one lateral edge of the recording sheet 2 and a shifted position beyond a remaining lateral edge of the recording sheet 2 on the opposite side.

The clutch claws 87 and 88 are deformed resiliently if load occurs in movement of the blade holder 48, and become disengaged from the blocking claws 89*b* and 89*c*. Upon the disengagement, the driven wheel 89 is rotated by movement of the toothed sector portion 89*a* with one of the two portions of the toothed belt 86. See FIGS. 9 and 10. When the toothed sector portion 89*a* becomes meshed with the remaining one of the two portions of the toothed belt 86, the clutch claws 87 and 88 become engaged again with the blocking claws 89*b* and 89*c*. Thus, the blade holder 48 moves in a direction reverse to that before.

The stoppers 80*a* and 80*b* are defined by the inside of the opening 80 in the top plate 71, and arranged in the width direction of the recording sheet 2. The blade holder 48, when in the initial position, contacts the stopper 80*a*, and when in the shifted position, contacts the stopper 80*b*. The clutch claws 87 and 88 are deformed also when the blade holder 48 contacts each one of the stoppers 80*a* and 80*b*, and become disengaged from the blocking claws 89*b* and 89*c*.

The clutch claws 87 and 88 remain undeformed even with load during operation of one of the first and second circular blades 45 and 47 cutting the recording sheet 2, but are deformed resiliently if load of one of the first and second circular blades 45 and 47 becomes higher than reference load in the normal cutting. Therefore, the blade holder 48 is returned to the initial position upon detection of load higher than the reference load.

If the recording sheet 2 should be stopped in an incorrect position at the time of cutting a front or rear margin, the recording sheet 2 is likely to lie on both cutting lines of the first and second circular blades 45 and 47. As the first and second circular blades 45 and 47 move together, the recording sheet 2 may be cut erroneously by the first and second circular blades 45 and 47 simultaneously. In the present embodiment, however, load occurs upon movement of the blade holder 48 at an amount over than a reference load when the first and second circular blades 45 and 47 start cutting the recording sheet 2 simultaneously. Then the blade holder 48 is controlled immediately to return to the initial position. Thus, the above-described problem is prevented.

Also, the blade holder 48 is immediately returned to the initial position when an extremely great number of recording sheets are cut, or when the at least one of the first and second circular blades 45 and 47 is damaged for any reason. It is possible to prevent jamming of the recording sheet 2 or other difficulties due to problems with the first and second circular blades 45 and 47.

Upon occurrence of those problems, the blade holder 48 returns to the initial position in a shorter time than upon moving of the blade holder 48 back and forth. In consideration of this, the controller 52 measures time points of opening and closing the first position detector switch 81 for detecting the initial position, to obtain a length of the time between the time points. The length of the time is compared with a reference value to judge whether the cutting is proper or not. If impropriety is detected, then the slitting and rear margin cutting are suppressed, and the feeder motor 21 and the cutter motor 38 are controlled to eject the recording sheet 2. Therefore, jamming of the recording sheet 2 due to failure in the cutting operation can be avoided in the printer.

A stopper mechanism is provided in the front and rear margin cutter group 30, and stops one of lateral edges of the recording sheet 2 disposed downstream in the cutting direction of the front and rear margin cutter group 30, for the purpose of causing margin dust to fall neatly into the dust receiver chamber 10*b*.

Figure 11:
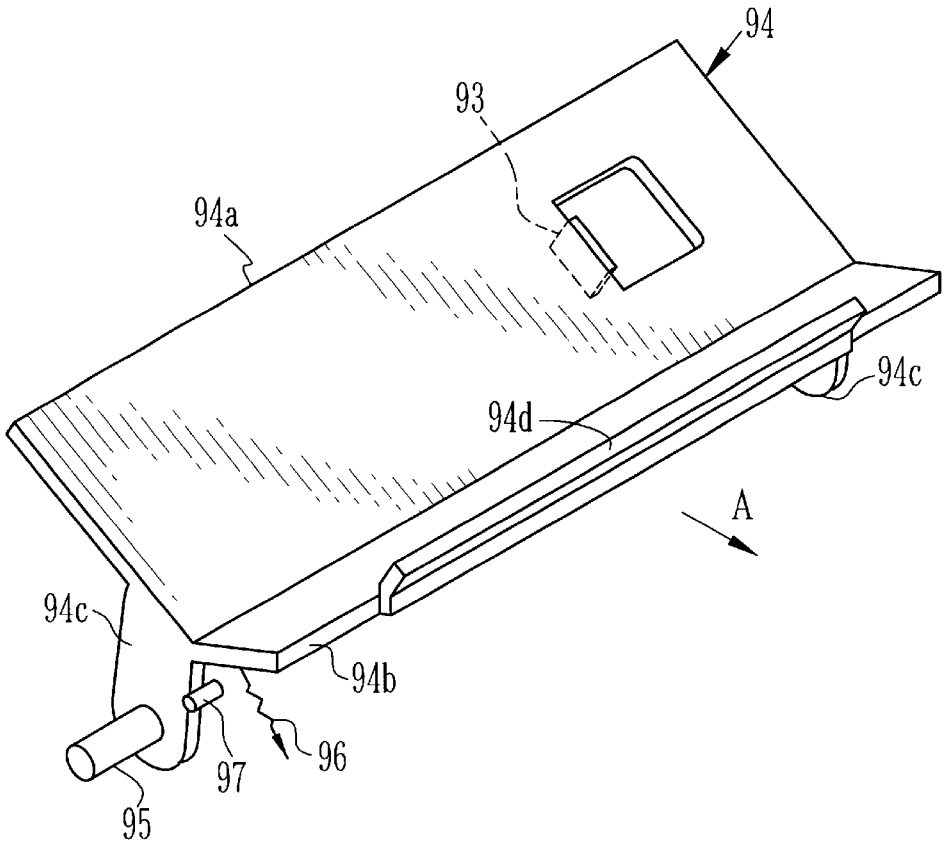
FIG. 11 is a perspective illustrating a guide plate with a stopper plate.
Figure 13:
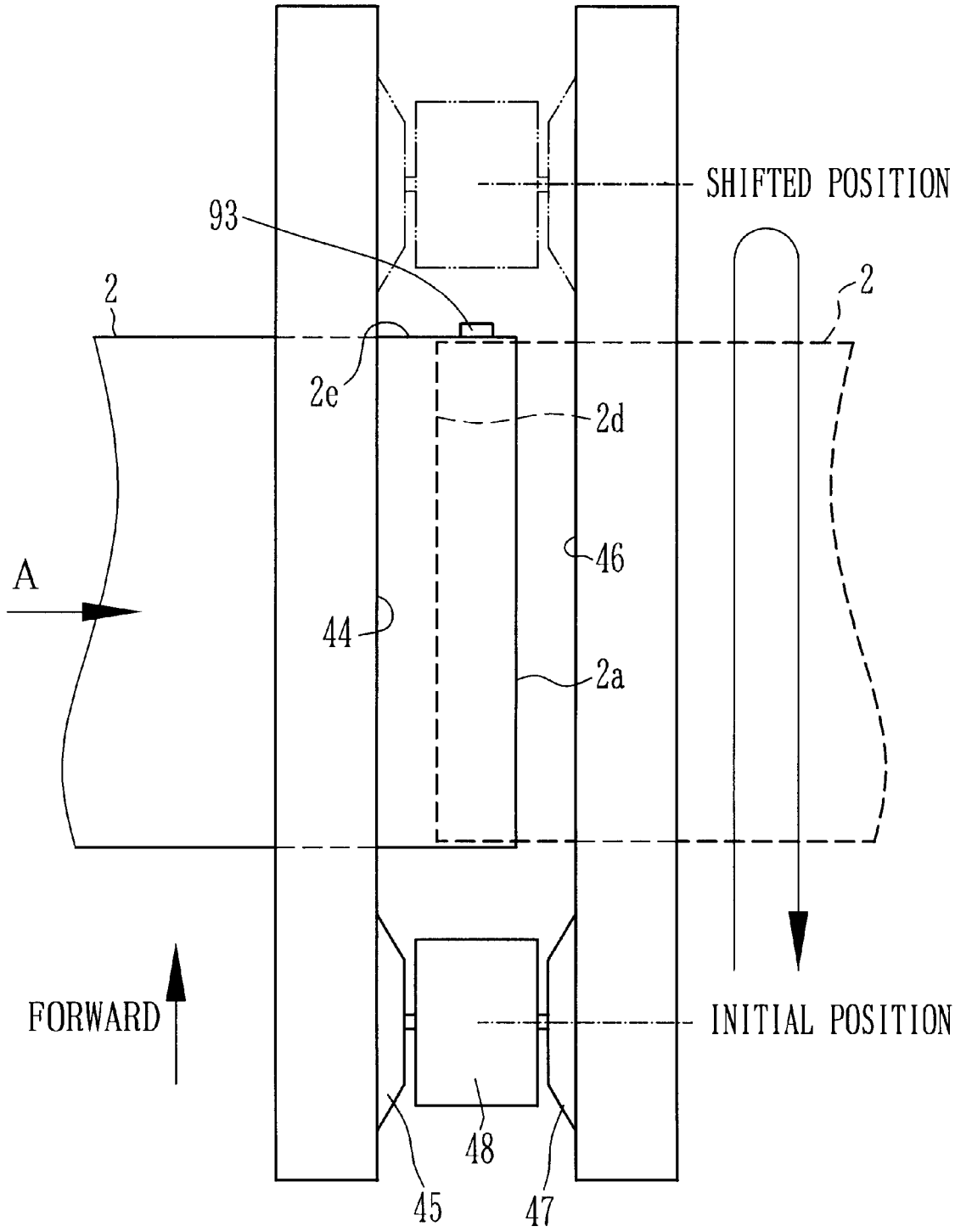
FIG. 13 is an explanatory view in plan illustrating the front and rear margin cutters.

In FIGS. 7, 11 and 13, the stopper mechanism is constituted by a stopper plate 93, a guide plate 94 and the like. The guide plate 94 is disposed between the first and second circular blades 45 and 47 and higher than the path of the recording sheet 2, and has a V-shape as viewed in the width direction of the recording sheet 2. One guide plate portion 94*a* of the guide plate 94 is provided with the stopper plate 93.

Support plate segments 94*c* are formed with the guide plate 94 and disposed beside the recording sheet 2 in its width direction. Support shafts 95 are disposed to project from the top plate 71, and support the support plate segments 94*c* in a rotatable manner. The guide plate 94 is kept rotatable between a first position and a second position, and when in the first position, sets the stopper plate 93 in a position of the feeding surface of the recording sheet 2, and when in the second position, sets the stopper plate 93 away from the feeding surface of the recording sheet 2. A spring 96 biases the guide plate 94 toward the second position. A stopper 97 or pin projects from the top plate 71, receives one of the support plate segments 94*c* and defines the second position of the guide plate 94. The guide plate 94 allows passage of the recording sheet 2 when in the second position.

A guide plate segment 94*b* of the guide plate 94 is provided with an engaging portion 94*d*, which constitutes a shifter mechanism. An engaging portion 98 in the shifter mechanism is formed with the blade holder 48, and engageable with the engaging portion 94*d*. See FIG. 7. When the blade holder 48 is moved forwards, the engaging portion 98 becomes engaged with the engaging portion 94*d*. Thus, the guide plate 94 rotates to the stopper position against the bias of the spring 96. The engaging portion 98 has an inclined surface directed in the forward direction, to smooth a swing of the guide plate 94. The stopper plate 93 comes in contact with a lateral edge of the recording sheet 2 in cutting of the front and rear margin cutter group 30 when the guide plate 94 is in the stopper position.

The length of the engaging portion 94*d* in the width direction of the recording sheet 2 is slightly smaller than a moving distance of the blade holder 48 in the forward movement. Thus, the engaging portion 98 does not become engaged with the engaging portion 94*d* when the blade holder 48 is in the initial position. The engaging portion 98, when moved from the initial position to a small extent, becomes engaged with the engaging portion 94*d* before the first or second circular blade 45 or 47 starts cutting the recording sheet 2. The engagement of the engaging portion 98 with the engaging portion 94*d* continues until the blade holder 48 is moved back again to the initial position.

Figure 14:
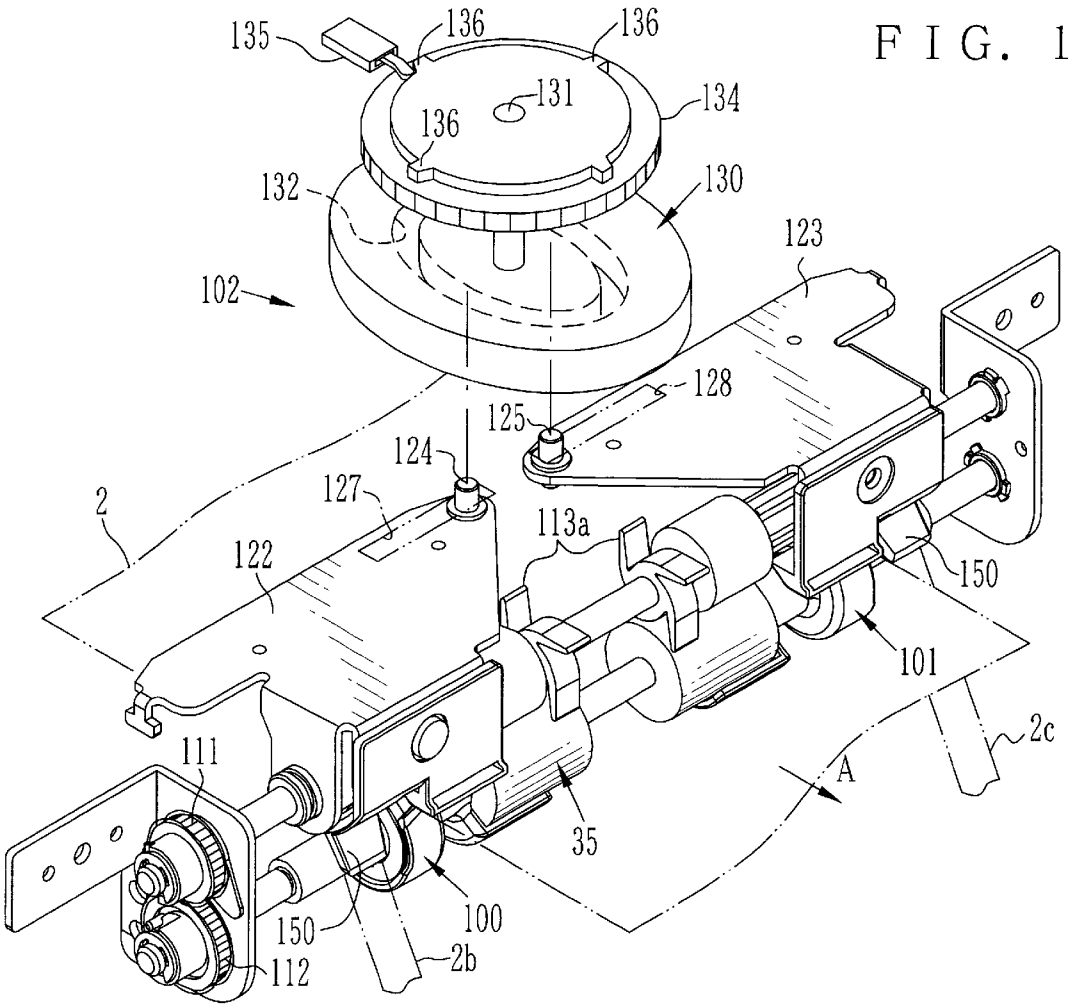
FIG. 14 is an exploded perspective illustrating a slitter unit.
Figure 15:
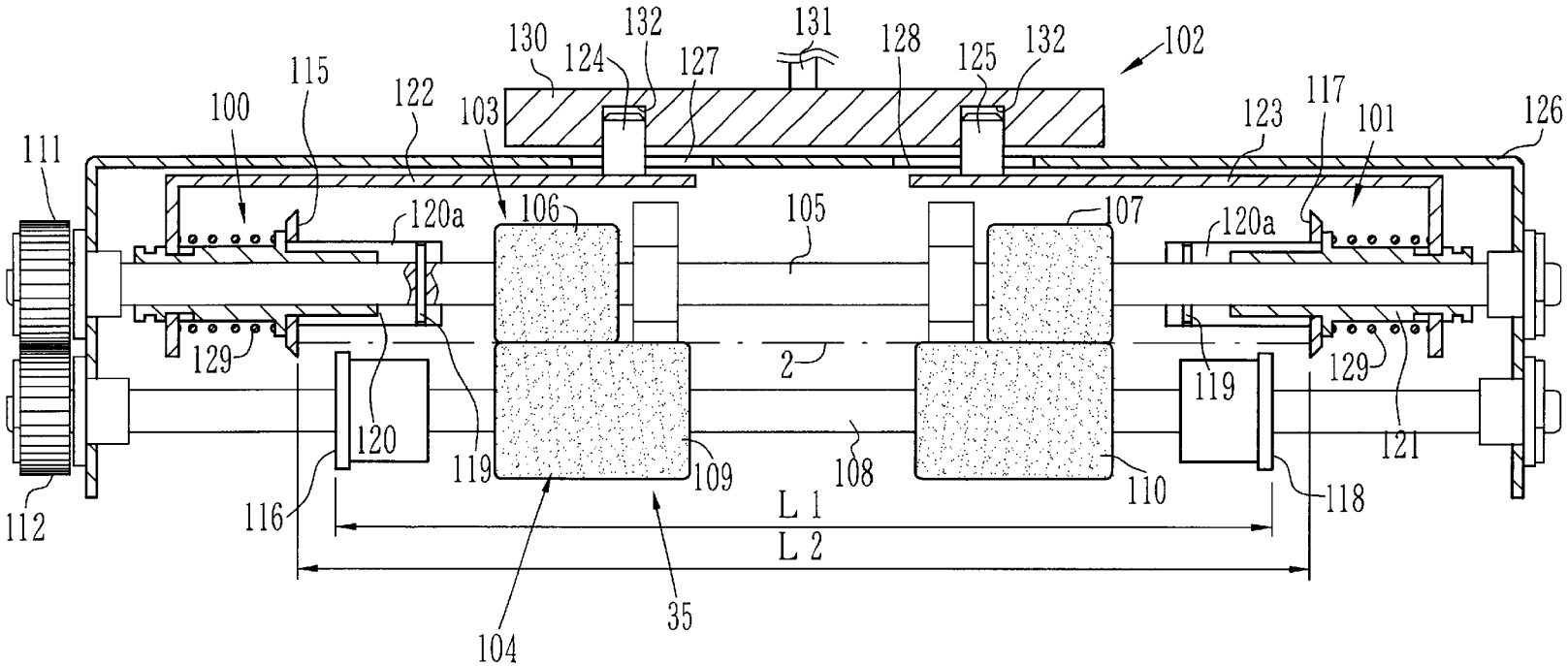
FIG. 15 is a front elevation, partially cutaway, illustrating the front and rear margin cutters.
Figure 16:
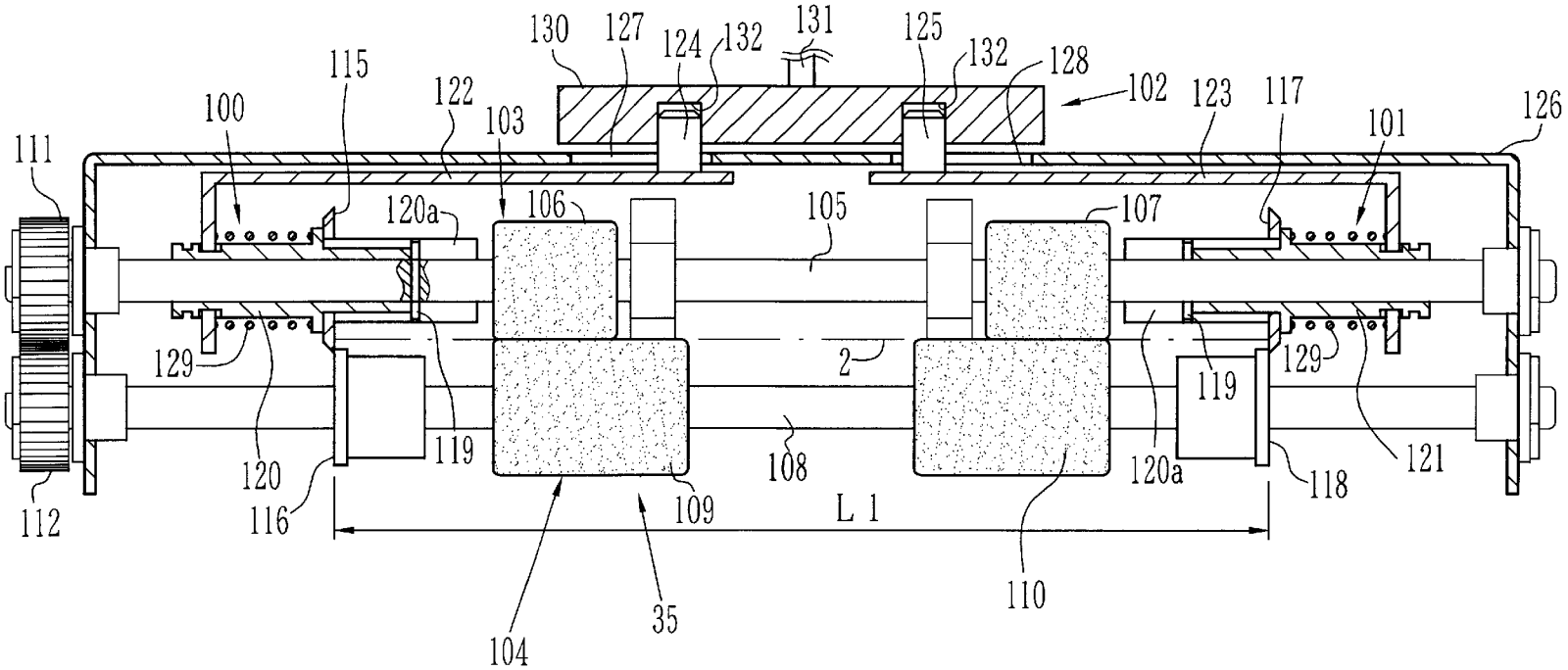
FIG. 16 is a front elevation, partially cutaway, illustrating the same as FIG. 15 but in which the rotary blades are ready to slit.

In FIGS. 14–16, the slitter unit 31 includes the slitter/ejector roller set 35, slitters 100 and 101 and a shifter mechanism 102. The slitters 100 and 101 slit the recording sheet 2 in the feeding direction to cut lateral margins away. The shifter mechanism 102 moves the slitters 100 and 101 in the width direction of the recording sheet 2. The shifter mechanism 102 shifts the slitters 100 and 101 between a first position for cutting the recording sheet 2 and a second position for allowing the recording sheet 2 to pass. The slitter/ejector roller set 35 includes an upper roller 103 and a lower roller 104, which nip the recording sheet 2 and send the same toward the ejection slot 7. The upper roller 103 is constituted by an upper roller shaft 105 and two roller elements 106 and 107. The upper roller shaft 105 extends in the width direction of the recording sheet 2. The roller elements 106 and 107 are fixedly disposed on the upper roller shaft 105 at a predetermined interval.

The lower roller 104 includes a lower roller shaft 108 and roller elements 109 and 110. The lower roller shaft 108 extends in parallel with the width direction of the recording sheet 2. The roller elements 109 and 110 are fixed on the lower roller shaft 108 and disposed to contact respectively the roller elements 106 and 107. Gears 111 and 112 are fixedly secured to ends of the roller shafts 105 and 108. As rotation of the feeder motor 21 is transmitted to the gear 111, the gears 111 and 112 rotate the roller shafts 105 and 108. Note that the slitters 100 and 101 are disposed symmetrically with each other with reference to a central line of the cutting path 6 in the width direction of the recording sheet 2. Also, the roller element 107 is symmetrical with the roller element 106. The roller element 110 is symmetrical with the roller element 109.

The slitter 100 is constituted by an upper rotary blade 115 and a lower rotary blade 116. The slitter 101 is constituted by an upper rotary blade 117 and a lower rotary blade 118. The lower rotary blades 116 and 118 are coaxial with the lower roller shaft 108, fixed on outer sides of the roller elements 109 and 110, and rotate with the lower roller shaft 108. An interval L1 in FIG. 15 between the lower rotary blades 116 and 118 is predetermined equal to or slightly smaller than a width of the recording region.

The upper rotary blades 115 and 117 are moved by the shifter mechanism 102 between first and second positions, and when in the first position, contact the lower rotary blades 116 and 118, and when in the second position, retreat in a manner flush with or away from lateral edges of the recording sheet 2. The shifter mechanism 102 has elements including blade sliding sleeves 120 and 121, guide brackets 122 and 123, and a cam mechanism, which moves the guide brackets 122 and 123 in a linked manner.

Figure 17:
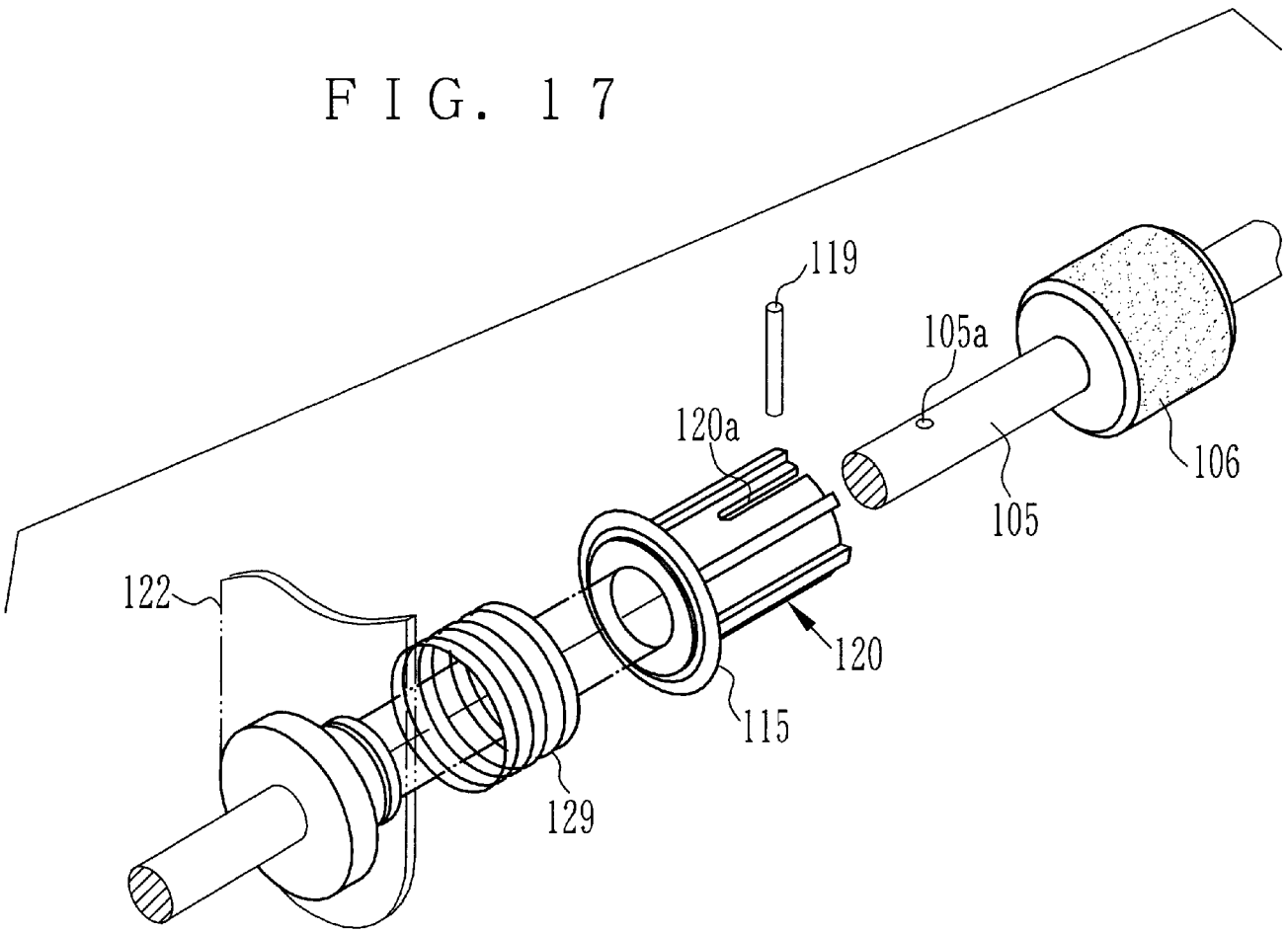
FIG. 17 is an exploded perspective illustrating an upper roller and an upper rotary blade.

The upper rotary blades 115 and 117 are secured to the blade sliding sleeves 120 and 121. As the blade sliding sleeve 121 is structurally equal to the blade sliding sleeve 120, the blade sliding sleeve 120 is mainly described. In FIG. 17, guide grooves 120*a* are formed in the blade sliding sleeve 120 to extend in parallel with the upper roller shaft 105, and arranged at a phase difference of half a rotation. A guide pin 119 is inserted in the guide grooves 120*a*. A hole 105*a* is formed in the upper roller shaft 105. An end of the guide pin 119 is inserted in one of the guide grooves 120*a*, the hole 105*a* and the remainder of the guide grooves 120*a*. Thus, the blade sliding sleeve 120 is kept movable in an axial direction of the upper roller shaft 105, and also rotatable together with the upper roller shaft 105.

The blade sliding sleeves 120 and 121 are supported by the guide brackets 122 and 123. A coil spring 129 is inserted between the blade sliding sleeve 120 and the guide bracket 122 and also between the blade sliding sleeve 121 and the guide bracket 123. The coil spring 129 biases the guide bracket 122 away from the blade sliding sleeve 120 in the axial direction of the upper roller shaft 105. Also, the guide bracket 123 is biased away from the blade sliding sleeve 121 in the axial direction.

The guide bracket 122 has first and second ends. The first end supports the blade sliding sleeve 120. A first cam pin 124 is provided in the second end. The guide bracket 123 also has a first end for supporting the blade sliding sleeve 121 and a second end provided with a second cam pin 125. The guide brackets 122 and 123 support the blade sliding sleeves 120 and 121 in a rotatable manner and with a small play in an axial direction of the upper roller shaft 105.

A cutter chassis 126 supports axial ends of the upper and lower rollers 103 and 104. There are rectilinear guide slots 127 and 128 formed in the cutter chassis 126, for keeping the first and second cam pins 124 and 125 movable in the width direction of the recording sheet 2.

A cam disk 130 constitutes a shifter mechanism, has an elliptical shape. A shaft 131 is fixedly secured to the cam disk 130. An elliptical cam groove 132 is formed in the cam disk 130, and receives the first and second cam pins 124 and 125. A gear 134 is secured to the shaft 131. Rotation of the input gear 58*a*, which has been described with FIG. 5, is transmitted to the gear 134. The cam disk 130 rotates in one direction, and causes the first and second cam pins 124 and 125 to move the guide brackets 122 and 123 in the width direction of the recording sheet 2 together. As the guide brackets 122 and 123 support the blade sliding sleeves 120 and 121, the upper rotary blades 115 and 117 move between the slitting position and retracted position. In the retracted position, an interval L2 between the upper rotary blades 115 and 117 in FIG. 15 is equal to or slightly greater than the width of the recording sheet 2.

The elliptical cam groove 132 has such a shape as to move the upper rotary blades 115 and 117 alternately between first and second positions at each time of a ¼ rotation of the cam disk 130. A phase detector mechanism is associated with the cam disk 130 for detection of a change of a phase of the cam disk 130 by a ¼ rotation. The phase detector mechanism is constituted by a phase detector switch 135 and four projections 136. The projections 136 are disposed on a top of the cam disk 130, and shaped to project radially away from a rotational axis of the cam disk 130. Each time that the cam disk 130 makes a ¼ rotation, one of the projections 136 turns on the phase detector switch 135. A signal from the phase detector switch 135 is sent to the controller 52.

The controller 52 receives a mode signal generated by the margin mode selector switch 55 to set one of the margin mode and the marginless mode. If the marginless mode is selected, the controller 52 drives the cutter motor 38 backwards, and rotates the cam disk 130 in one direction. While the cutter motor 38 is driven, an output from the phase detector switch 135 is monitored. When the controller 52 receives an ON signal generated by the phase detector switch 135, then the controller 52 discontinues driving the cutter motor 38.

In FIG. 14, dust separators 150 are secured to the guide brackets 122 and 123, and guide margin dust 2*b* and 2*c* from the cutting path 6 to the dust receiver chamber 10*b* after slitting in the slitters 100 and 101.

The operation of the above embodiment is described now. When the printer is initialized, the thermal head 15 is positioned away from the platen roller 16. The pinch roller 20 in the feeder rollers 18 is set away from the capstan roller 19.

The blade holder 48 in the front and rear margin cutter group 30 is in the initial position, so the first and second circular blades 45 and 47 do not block passage of the recording sheet 2. Also, the guide plate 94 is in the retracted position. The upper rotary blades 115 and 117 in the slitter unit 31 are in the retracted position where those retreat at the lateral edges of 2 or retreat outside the lateral edges of the recording sheet 2.

Before the printing is started, the margin mode selector switch 55 is operated to input one of the margin mode and marginless mode. The printing button 54 is operated after the mode selection, before the controller 52 causes supply of the recording sheet 2. The recording sheet 2 is fed from the sheet supply unit 3 toward the thermal head 15.

The recording sheet 2 is fed in a state oriented to set a recording surface downwards in FIG. 2. The recording sheet 2 moves in the backward direction B, is passed between the capstan roller 19 and the pinch roller 20 in the feeder rollers 18, and then passed between the thermal head 15 and the platen roller 16. A rear edge of the recording sheet 2, as viewed with reference to the backward direction B, is detected by the position sensor 22. Responsively, driving of the feeder motor 21 is discontinued. The pinch roller 20 is shifted to a position to contact the capstan roller 19. Those squeeze the recording sheet 2.

After the feeder rollers 18 are shifted for nipping, the thermal head 15 is moved to the printing position. Then the feeder motor 21 is driven to rotate the capstan roller 19. The recording sheet 2 is fed in the forward direction A of feeding.

During the feeding, the controller 52 monitors data of a feeding amount obtained from the encoder 23. When a front edge of a recording region is detected to lie in a position of the thermal head 15, the controller 52 drives the thermal head 15 to record yellow to the recording region in the recording sheet 2 one line after another. In the thermal recording, the yellow fixing lamp 25 in the fixer 24 is turned on to fix the yellow coloring layer optically after recording.

When the yellow recording is completed, the thermal head 15 is shifted to the retracted position. The recording sheet 2 is fed in the backward direction B until the position sensor 22 detects the rear edge as viewed in the backward direction B. Again, the recording sheet 2 is fed in the forward direction A. The thermal head 15 is shifted to the printing position while the recording sheet 2 is fed. The thermal head 15 records magenta to the recording region. Also, the magenta fixing lamp 26 is driven to fix the magenta coloring layer photochemically.

When the magenta recording is completed, a cyan image is recorded in a similar manner. During the cyan recording, the magenta fixing lamp 26 is turned on to bleach unrecorded regions.

When the cyan recording is completed, a full-color image is recorded in the recording region according to the three-color frame-sequential recording. After this, the feeder rollers 18 feed the recording sheet 2 to the cutter device 14.

Before the feeding, the controller 52 controls the slitter unit 31 to set the upper rotary blades 115 and 117 in the slitting position. For this control, the cutter motor 38 is driven to rotate in a backward direction. Rotation of the cutter motor 38 is transmitted by the first transmission mechanism 58 to the shaft 131, and then to the cam disk 130. The cam disk 130 rotates in one predetermined direction. The first and second cam pins 124 and 125 engaged with the elliptical cam groove 132 are moved by movement of intersection points between the elliptical cam groove 132 and the guide slots 127 and 128. Then the guide brackets 122 and 123 are shifted. The shift of the guide brackets 122 and 123 is transmitted to the blade sliding sleeves 120 and 121.

While the controller 52 drives the cutter motor 38, the controller 52 monitors an output from the phase detector switch 135. Upon an ON signal from the phase detector switch 135, the controller 52 discontinues driving the cutter motor 38. The guide brackets 122 and 123 are shifted to the slitting position, to cause the upper rotary blades 115 and 117 to contact the lower rotary blades 116 and 118 in the axial direction. The spring 129 keeps the upper rotary blades 115 and 117 in contact with the lower rotary blades 116 and 118.

The recording sheet 2 is fed to the cutter device 14 depicted in FIG. 3. When a front edge of the recording sheet 2 is detected by the position sensor 51, the controller 52 discontinues driving the feeder motor 21. A line designated for cutting at the front margin of the recording sheet 2 is set in the cutting position of the first circular blade 45.

Figure 9:
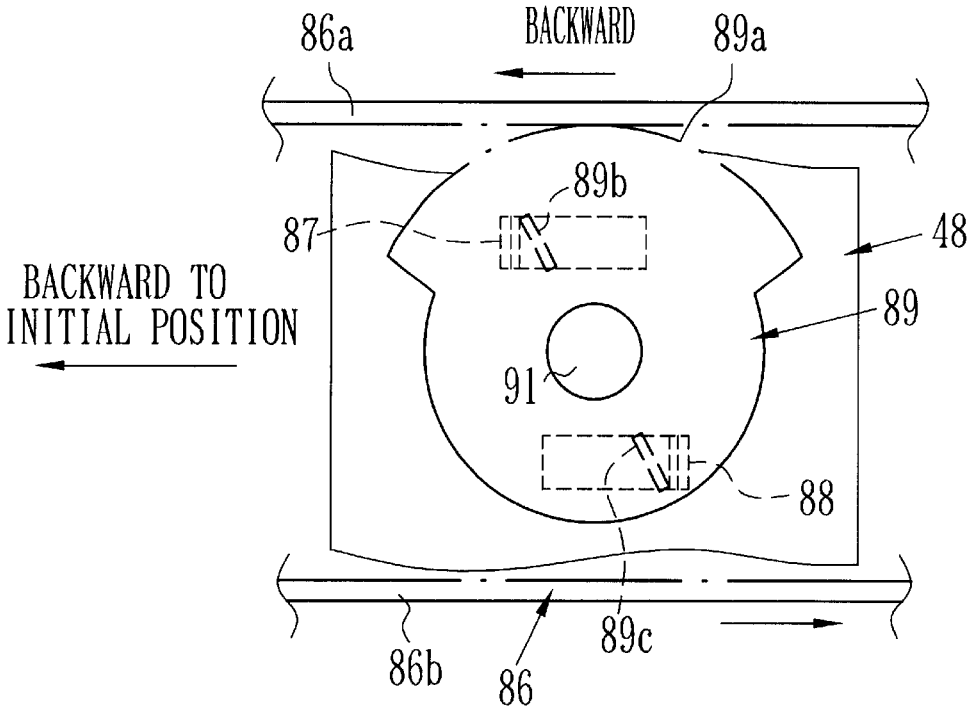
FIG. 9 is an explanatory view in plan illustrating the blade holder driver operating for backward movement.

Then the cutter motor 38 is rotated in the forward direction. The planet gear 61 comes in mesh with the second transmission mechanism 59 to turn the toothed belt 86 in one direction. As illustrated in FIG. 9, the driven wheel 89 is in an initial state with the toothed sector portion 89*a* meshed with the first belt portion 86*a*. The blade holder 48 is moved in the backward direction at first. Upon movement, the blade holder 48 contacts the stopper 80*a* soon on the side of the initial position. Thus, the clutch claws 87 and 88 are resiliently deformed and disengaged from the blocking claws 89*b* and 89*c*. The driven wheel 89 rotates in the counterclockwise direction about the shaft 91.

Figure 10:
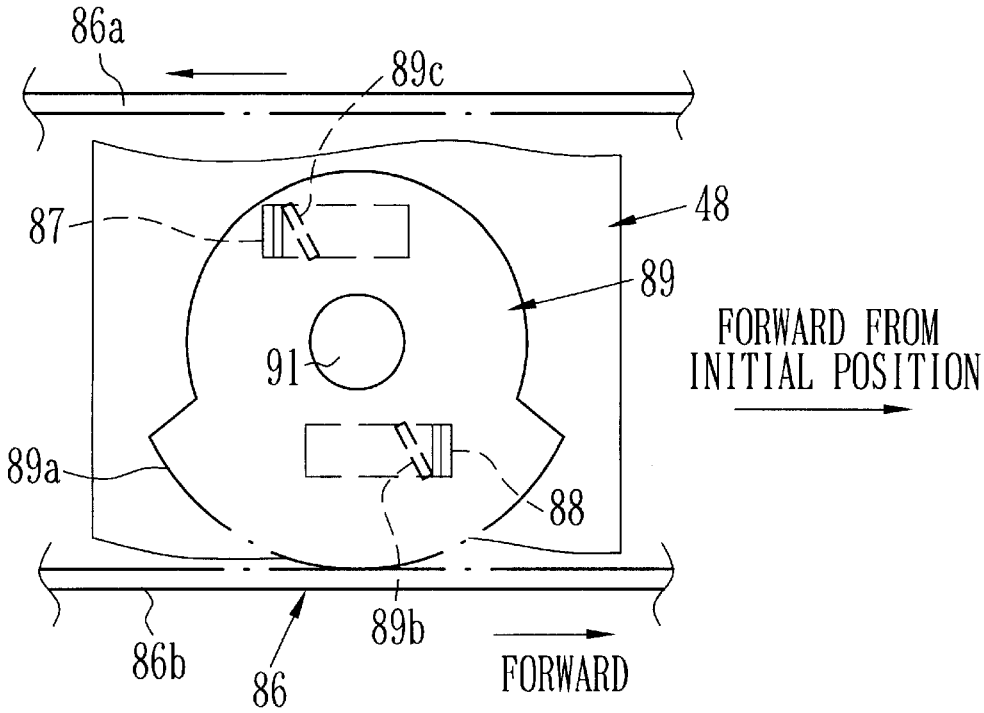
FIG. 10 is an explanatory view in plan illustrating the blade holder driver operating for forward movement.

The toothed sector portion 89*a* of the driven wheel 89, as illustrated in FIG. 10, is meshed with the second belt portion 86*b*. The blocking claws 89*b* and 89*c* are engaged with the clutch claws 87 and 88. Thus, the blade holder 48 moves in the forward direction the same as that of the second belt portion 86*b*. The first and second circular blades 45 and 47 are moved together.

Figure 12:
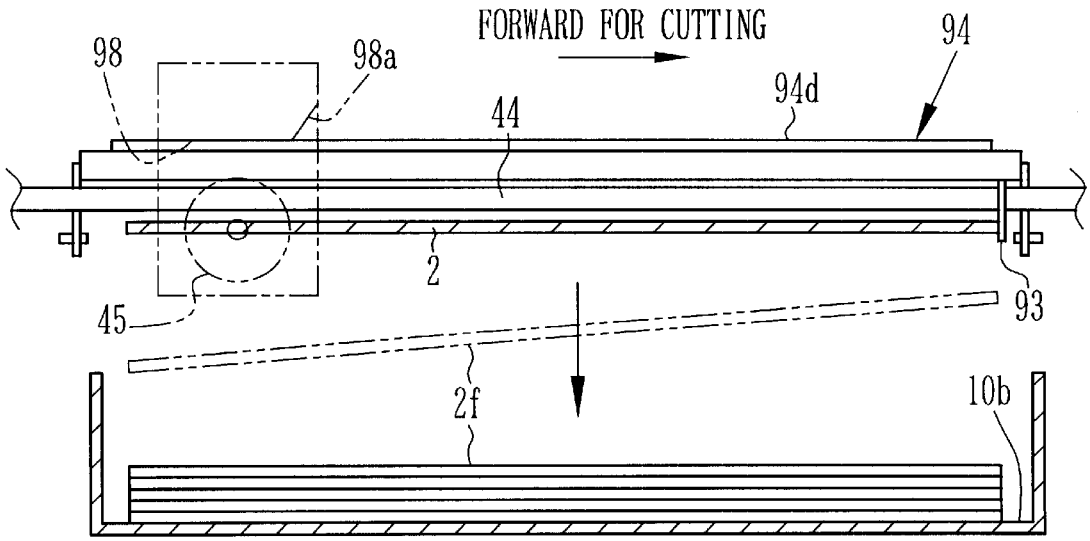
FIG. 12 is an explanatory view in section illustrating cutting of a margin in the front and rear margin cutters.

The blade holder 48 moving forwards, an inclined surface 98*a* of the engaging portion 98 becomes engaged with the engaging portion 94*d* before the first circular blade 45 contacts the recording sheet 2. See FIG. 12. The inclined surface 98*a* pushes the engaging portion 94*d*. Thus, the guide plate 94 swings toward the stopper position against the spring 96. When the blade holder 48 continues to move, its portion positioned beyond the inclined surface 98*a* becomes engaged with the engaging portion 94*d*. Now, the guide plate 94 is in the stopper position. The stopper plate 93, as viewed in the width direction of the recording sheet 2, is flush with a side edge 2*e* of the recording sheet 2. In FIG. 13, the stopper plate 93 contacts, or is close to, the side edge 2*e* of the recording sheet 2 close to a front edge 2*a* of the recording sheet 2.

The blade holder 48 continuing moving, the first circular blade 45 cuts the recording sheet 2 in the width direction by cooperating with the first stationary blade 44. Although the first circular blade 45 applies pushing force to the recording sheet 2 in the forward direction for cutting, the stopper plate 93 keeps the recording sheet 2 from moving. Thus, the recording sheet 2 can be cut smoothly. At the end of cutting of the first circular blade 45, it is likely that the side edge 2*e* of the recording sheet 2 interferes between the first circular blade 45 and the first stationary blade 44, and that the front margin receives force to move with the first circular blade 45. However, the stopper plate 93 keeps the front margin from moving. Thus, the recording sheet 2 can be cut reliably. It is to be noted that the second circular blade 47 moves also in the front margin cutting. However, no recording sheet lies in the position of the second circular blade 47, which does not cut anything.

When the first circular blade 45 cuts away the front margin, dust of a front margin region 2*f* drops into the dust receiver chamber 10*b*. See FIG. 12. No matter how much dust drops by the repeated cutting of the front margin region 2*f*, a position of this drop can be neatened. The dust can be collected and discarded easily from the dust receiver chamber 10*b*.

When the blade holder 48 is in the shifted position, the blade holder 48 contacts the stopper 80*b*. Further movement of the blade holder 48 is blocked to deform the clutch claws 87 and 88, which are disengaged from the blocking claws 89*b* and 89*c*. Upon the disengagement, the driven wheel 89 in FIG. 10 rotates in the counterclockwise direction, to mesh the toothed sector portion 89*a* with the first belt portion 86*a*. In FIG. 9, the blocking claws 89*b* and 89*c* become again engaged with the clutch claws 87 and 88, to block rotation of the driven wheel 89. The blade holder 48 moves in the backward direction from the shifted position to the initial position. Upon the reach to the initial position, the blade holder 48 turns on the first position detector switch 81. In response to this, the controller 52 stops driving the cutter motor 38. Cutting of the front margin is completed.

When the blade holder 48 moves back to the initial position, the engaging portion 94*d* is disengaged from the engaging portion 98. Thus, the guide plate 94 is swung to the retracted position by the force of the spring 96. Thus, it is possible to prevent interference of the side edge 2*e* of the recording sheet 2 with the stopper plate 93.

After the front margin cutting, the controller 52 drives the feeder motor 21 to feed the recording sheet 2 in the forward direction A. A front edge of the recording sheet 2 is nipped by the slitter/ejector roller set 35. Lateral margins are slitted away from the recording sheet 2 by the rotary blades 115–118 in the slitter unit 31. When a rear edge of the recording sheet 2 is detected by the position sensor 50, the controller 52 discontinues driving the feeder motor 21. Thus, a target position in the recording sheet 2 for the rear margin is set at the second circular blade 47. After this, the controller 52 causes the cutter motor 38 to rotate forwards, and causes the blade holder 48 to move forwards and backwards in the manner similar to the above. Thus, the first and second circular blades 45 and 47 move together with the blade holder 48. In the forward movement, the second circular blade 47 cuts the rear margin from the recording sheet 2 with the second stationary blade 46. In the meantime, the first circular blade 45 does not cut the recording sheet 2.

In the course of cutting the rear margin with the second circular blade 47, the operation is similar to the above. When the blade holder 48 moves from the initial position, the engaging portion 98 pushes the engaging portion 94*d* to swing the guide plate 94 to the stopper position. In FIG. 13, the side edge 2*e* of a rear edge 2*d* of the recording sheet 2 indicated by the dotted line is received by the stopper plate 93. Dust from the rear margin cutting is collectively dropped in the dust receiver chamber 10*b*. In the present embodiment, the front and rear margin cutters 33 and 34 are arranged close to each other in the feeding direction. Dust created by the front and rear margin cutting can be stacked piece on piece, and treated easily.

After the rear margin cutting is completed, the controller 52 drives the feeder motor 21 again. As the recording sheet 2 is fed by the slitter/ejector roller set 35, the rotary blades 115–118 continue cutting of both lateral margins. After cutting of the front and rear margins and lateral margins, the recording sheet 2 is ejected by the slitter/ejector roller set 35 to the outside through the ejection slot 7. After the ejection, the cutter motor 38 is caused to rotate backwards, to move the upper rotary blades 115 and 117 to the retracted position. Thus, the printer becomes ready for a succeeding operation of printing.

If the margin mode is designated by operating the margin mode selector switch 55, the feeder motor 21 is consecutively driven after the image recording. The recording sheet 2 is ejected by the slitter/ejector roller set 35 from the printer through the ejection slot 7. When the recording sheet 2 passes the cutter device 14, no problem occurs because the upper rotary blades 115 and 117 in the slitter unit 31 are shifted away not to block the recording sheet 2.

The margin dust 2*b* and 2*c* cut away from the slitter unit 31 is dropped to the dust receiver chamber 10*b*. As the margin dust 2*b* and 2*c* is created by slitting of lateral margins of the recording sheet 2, the margin dust 2*b* and 2*c* is collected in a position different from that for the front margin region 2*f*.

If a plurality of prints are desired and also if the marginless mode is designated, next operation of printing is started with the upper rotary blades 115 and 117 set in the slitting position in the slitter unit 31. After the three-color frame-sequential recording, the front and rear margin cutter group 30 is actuated to cut front and rear margins.

It is to be noted that examples of sizes related to the margin mode and the marginless mode can be a postcard size and the L-size well-known in the art of photograph according to silver halide photography. If margins are cut away, a print can be treated in the same manner as a photographic print and easily attached to a page of an album. If margins are kept without being cut, a print can be used as a postcard itself.

Note that the thermal printer of the present invention may be any type, such as a thermal transfer type for use with ink ribbon or ink sheet. Also, the thermal printer may be a color thermal printer or monochromatic thermal printer. Furthermore, the printer may be an ink jet printer, wire dot printer, and the like.

In the above embodiment, the recording sheet 2 is a single sheet. However, sheet material according to the present invention may be continuous sheet material drawn from a roll. In the above embodiment, the cutter device is incorporated in the printer. However, a cutter device may be separate from a printer or any other device.

In the above embodiment, the first and second circular blades 45 and 47 are commonly supported on the blade holder 48. However, two blade holders may be used for separately supporting the first and second circular blades 45 and 47. Also, only one margin cutter including a movable blade and a stationary blade may be used, and commonly operated for the front and rear margin cutting. In the above embodiment, the cutter motor is rotated only in one direction for cutting. However, a cutter motor may rotate forwards and backwards for moving the blade holder 48 back and forth.

Figure 18:
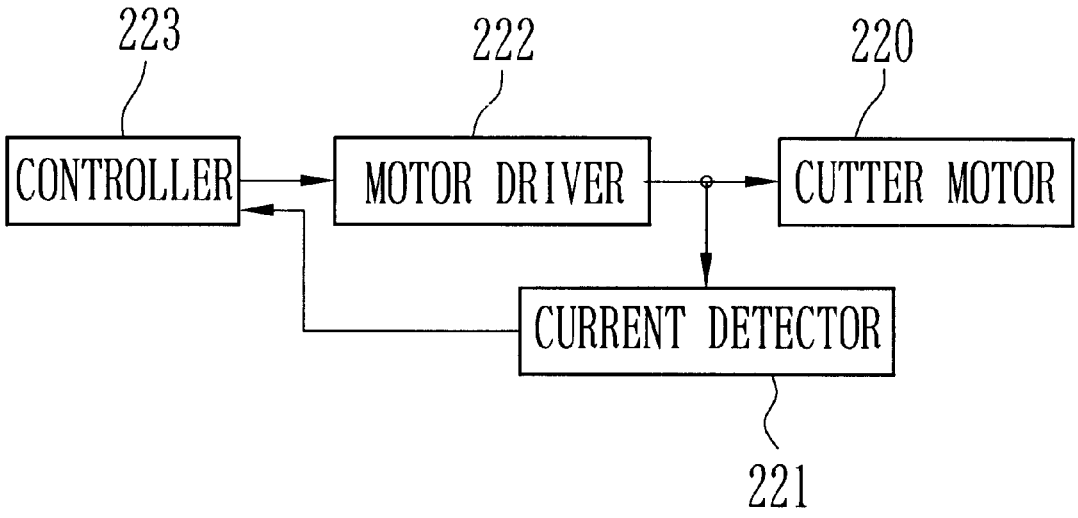
FIG. 18 is a block diagram illustrating another preferred embodiment with circuits for moving the blade holder.

For this control with the motor, difficulties in cutting are avoided by detection of load applied to the blade holder 48 according to a current flowing in the motor. In FIG. 18, a preferred embodiment is depicted. A cutter motor 220 rotates forwards and backwards to cause the blade holder 48 to move forwards and backwards. A current detector 221 detects overload applied to the cutter motor 220 by measuring a current flowing in the cutter motor 220. A controller 223 is supplied by the current detector 221 with a digital signal representing a value of the current. A motor driver 222 is controlled by the controller 223 to drive the cutter motor 220. Also, the controller 223 monitors the value of the current obtained by the current detector 221. If the value of the current becomes higher than a reference range, the controller 223 controls the motor driver 222 to change the rotational direction of the cutter motor 220. Accordingly, proper cutting is possible when only one of the first and second circular blades 45 and 47 cuts the recording sheet 2, because the value of the current is within the reference range. If both the first and second circular blades 45 and 47 simultaneously come in contact with the recording sheet 2, or if one of the first and second circular blades 45 and 47 comes in contact with two overlapped recording sheets, the value of the current becomes over the reference range. Then the controller 223 forcibly moves the blade holder 48 to the initial position.

Note that, for the purpose of changing over the direction of moving the blade holder 48, an output of the second position detector switch 82 can be monitored to control the cutter motor 220.

In any of the above embodiment, the stopper plate 93 is movable. However, the stopper plate 93 may be stationary, because the stopper plate 93 is positioned exactly at the lateral edge of the recording sheet 2, or outside the lateral edge of the recording sheet 2. In the above embodiment, the stopper plate 93 is rotated to the retracted position. However, the stopper plate 93 may be slid straight. Furthermore, a frictional member may be used instead of the stopper plate 93 for stopping the recording sheet 2. The frictional member can be attached to the guide plate 94, for retaining a front or rear margin to be cut. A portion to be cut may be squeezed between the frictional member and a surface of the stationary blade opposed to a feeding path. For time sequential control, the frictional member can be caused to squeeze this before or after the cutting operation. Furthermore, the front and rear margin cutter group 30 may have straight blades instead of the circular blades. The straight blades can be a drop type in which a first end is dropped initially and a second end is dropped later than the first end. It is effective to retain an edge of the recording sheet opposite to the dropping direction.

Furthermore, the guide plate 94 may have a shape other than the V-shape described above, for example, may be a flat plate, long arms or the like.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A cutter device for cutting sheet material comprising:

at least one stationary blade having a stationary blade cutting edge extending in a first direction crosswise to said sheet material;

at least one movable blade for moving in said first direction in contact with said stationary blade cutting edge to cut said sheet material; and a retention mechanism for preventing said sheet material from being moved by said movable blade while said movable blade cuts said sheet material;

further comprising a moving mechanism for moving said movable blade forwards along said stationary blade cutting edge from a first position to a second position, and then for moving said movable blade backwards from said second position to said first position to cause said movable blade to stand by; and wherein said retention mechanism includes a stopper plate, disposed close to said second position of said movable blade, for contacting a side edge of said sheet material to prevent said sheet material being cut from moving in said first direction.

2. A cutter device as defined in claim 1, further comprising a guide member for guiding said sheet material being fed in a position downstream or upstream from said stationary and movable blades, said stopper plate being formed to project from said guide member and opposed to said sheet material.

3. A cutter device as defined in claim 2, further comprising a shifter mechanism for causing said guide member to shift said stopper plate between a stopper position and a retracted position, wherein said stopper plate, when in said stopper position, contacts said side edge, and when in said retracted position, is away from said side edge.

4. A cutter device as defined in claim 3, wherein said movable blade is disposed away from said sheet material when in said first position, and starts cutting said sheet material when moved from said first position to a cutting starting position;

said shifter mechanism moves said stopper plate to said stopper position while said movable blade is moved from said first position to said cutting starting position, and keeps said stopper plate in said stopper position while said movable blade is between said cutting starting position and said second position.

5. A cutter device as defined in claim 4, further comprising a blade holder for supporting said movable blade and for being moved by said moving mechanism.

6. A cutter device as defined in claim 5, wherein said shifter mechanism includes:

a first engaging portion formed with said guide member; and a second engaging portion, formed with said blade holder, for setting said stopper plate in said stopper position by pushing said first engaging portion.

7. A cutter device as defined in claim 5, wherein said moving mechanism includes:

a cutter motor for rotating in one direction;

an endless belt or chain, having first and second portions extending substantially in parallel with each other, and turned by said cutter motor;

a clutch for causing said blade holder to move in said first direction by transmitting movement of said first portion thereto, and to move in a second direction reverse to said first direction by transmitting movement of said second portion thereto.

8. A cutter device as defined in claim 5, wherein said moving mechanism includes a cutter motor for moving said blade holder in said first direction by rotating forwards, and for moving said blade holder in a second direction reverse to said first direction by rotating backwards.

9. A cutter device as defined in claim 5, wherein said movable blade is a rotatable circular blade.

10. A cutter device as claimed in claim 1, wherein said sheet material is a recording sheet, and includes:

a recording region adapted to image recording;

first and second margin regions positioned in front of and behind said recording region;

wherein said at least one movable blade cuts said first or second margin region away from said recording region.

11. A cutter device as defined in claim 10, wherein said at least one movable blade is first and second movable blades, and said at least one stationary blade is first and second stationary blades;

said first movable blade and said first stationary blade constitute a first cutter for cutting away said first margin region;

said second movable blade and said second stationary blade constitute a second cutter for cutting away said second margin region, and are positioned downstream from said first cutter in a feeding direction of said recording sheet;

wherein said retention mechanism is arranged between said first and second cutters, and operates while said first cutter is actuated or while said second cutter is actuated.

12. A cutter device as defined in claim 11, further comprising a blade holder for moving in said first direction and a second direction reverse thereto, and for supporting said first and second movable blades secured thereto.

13. A cutter device as defined in claim 12, further comprising:

a feeder for feeding said sheet material in said feeding direction;

a controller for controlling said feeder to position said first margin region at said first stationary blade in cutting thereof, and to position said second margin region at said second stationary blade in cutting thereof.

14. A cutter device as defined in claim 13, further comprising a dust receiver chamber, disposed substantially under said first and second stationary blades, for receiving said first or second margin region cut away from said recording region.

15. A printer comprising:

an image recorder for image recording to a recording sheet, said recording sheet including a recording region adapted to image recording, and first and second margin regions unrecorded and positioned in front of and behind said recording region in a feeding direction;

at least one stationary blade, having a stationary blade cutting edge extending in a width direction of said recording sheet;

at least one movable blade for moving in said width direction in contact with said stationary blade cutting edge to cut said first or second margin region away from said recording region;

a retention mechanism for preventing said recording sheet from being moved by said movable blade while said movable blade cuts away said first or second margin region; and a feeder for feeding said recording sheet for said image recording, cutting of said first or second margin region, and ejection of said recording sheet;

further comprising a moving mechanism for moving said movable blade forwards along said stationary blade cutting edge from a first position to a second position, and then for moving said movable blade backwards from said second position to said first position to cause said movable blade to stand by;

wherein said retention mechanism includes a stopper plate, disposed close to said second position of said movable blade, for contacting a side edge of said recording sheet to prevent said recording sheet being cut from moving.

16. A printer as defined in claim 15, further comprising a blade holder for supporting said movable blade and for being moved by said moving mechanism.

17. A printer as defined in claim 16, wherein said movable blade is a rotatable circular blade.

18. A printer as defined in claim 17, wherein said at least one movable blade is first and second movable blades, and said at least one stationary blade is first and second stationary blades;

said first movable blade and said first stationary blade constitute a first cutter for cutting away said first margin region;

said second movable blade and said second stationary blade constitute a second cutter for cutting away said second margin region, and are positioned downstream from said first cutter in a feeding direction of said recording sheet;

wherein said retention mechanism is arranged between said first and second cutters, and receives said side edge while said first cutter is actuated or while said second cutter is actuated.

19. A printer as defined in claim 18, further comprising a shifter mechanism for shifting said stopper plate from a retracted position to a stopper position before start of cutting of said first or second movable blade, said stopper plate contacting said side edge when in said stopper position.

20. A printer as defined in claim 19, further comprising a dust receiver chamber, disposed substantially under said blade holder, for receiving said first or second margin region cut away from said recording region.

* * * * *